US006802895B2

(12) United States Patent
Mackey et al.

(10) Patent No.: US 6,802,895 B2
(45) Date of Patent: Oct. 12, 2004

(54) NON-THERMOPLASTIC STARCH FIBERS AND STARCH COMPOSITION FOR MAKING SAME

(75) Inventors: Larry Neil Mackey, Fairfield, OH (US); Gregory Charles Gordon, Cincinnati, OH (US); Lora Lee Buchanan, Cincinnati, OH (US); Stephen Wayne Heinzman, Cincinnati, OH (US); Paul Arlen Forshey, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/741,254

(22) Filed: Dec. 19, 2003

(65) Prior Publication Data

US 2004/0149165 A1 Aug. 5, 2004

Related U.S. Application Data

(63) Continuation of application No. 10/062,393, filed on Feb. 1, 2002, now Pat. No. 6,723,160.

(51) Int. Cl.[7] ..... C08L 3/02; C08L 3/10; D04H 1/00; A61F 13/15; A61F 13/53; D21H 13/30

(52) U.S. Cl. ..... 106/206.1; 106/208.1; 106/208.3; 106/208.4; 106/208.5; 106/210.1; 106/214.2; 106/215.1; 106/217.01; 106/217.1; 524/47; 524/49; 524/50; 162/100; 162/231; 442/340; 442/414; 428/292.1; 428/332; 604/367

(58) Field of Search ..... 106/206.1, 208.1, 106/208.3, 208.4, 208.5, 210.1, 214.2, 215.1, 217.01, 217.1; 524/47, 49, 50; 604/367; 428/332, 292.1; 442/340, 414; 162/100, 231

(56) References Cited

U.S. PATENT DOCUMENTS

| | | | |
|---|---|---|---|
| 1,856,401 | A | 5/1932 | Prince |
| 1,885,256 | A | 11/1932 | Gull |
| 2,570,449 | A | 10/1951 | Horsak |
| 2,902,336 | A | 9/1959 | Hiemstra et al. |
| 3,117,014 | A | 1/1964 | Klug |
| 3,137,592 | A | 6/1964 | Protzman et al. |
| 3,280,229 | A | 10/1966 | Simons |
| 3,379,811 | A | 4/1968 | Hartmann et al. |
| 3,499,074 | A | 3/1970 | Barger et al. |
| 3,954,361 | A | 5/1976 | Page |
| 4,069,177 | A | 1/1978 | Smith |
| 4,076,663 | A | 2/1978 | Masuda et al. |
| 4,115,332 | A | 9/1978 | Young et al. |
| 4,117,222 | A | 9/1978 | Holst et al. |
| 4,139,699 | A | 2/1979 | Hernandez et al. |
| 4,243,480 | A | 1/1981 | Hernandez et al. |
| 4,340,563 | A | 7/1982 | Appel et al. |
| 4,380,570 | A | 4/1983 | Schwarz |
| 4,627,811 | A | 12/1986 | Greiser et al. |
| 4,673,438 | A | 6/1987 | Wittwer et al. |
| 4,818,463 | A | 4/1989 | Buehning |
| 4,826,415 | A | 5/1989 | Mende |
| 4,853,168 | A | 8/1989 | Eden et al. |
| 4,855,179 | A | 8/1989 | Bourland et al. |
| 4,900,361 | A | 2/1990 | Sachetto et al. |
| 5,079,354 | A | 1/1992 | Gross et al. |
| 5,095,054 | A | 3/1992 | Lay et al. |
| 5,122,048 | A | 6/1992 | Deeds |
| 5,234,977 | A | 8/1993 | Bastioli et al. |
| 5,275,774 | A | 1/1994 | Bahr et al. |
| 5,277,761 | A | 1/1994 | Van Phan et al. |
| 5,280,055 | A | 1/1994 | Tomka |
| 5,286,770 | A | 2/1994 | Bastioli et al. |
| 5,288,765 | A | 2/1994 | Bastioli et al. |

(List continued on next page.)

FOREIGN PATENT DOCUMENTS

| | | |
|---|---|---|
| EP | 0 108 364 B1 | 8/1986 |
| EP | 0 232 121 | 8/1987 |
| EP | 0 080 382 B1 | 8/1988 |
| EP | 0 327 505 B2 | 8/1989 |
| EP | 0 522 358 A2 | 1/1993 |
| EP | 0 541 050 A2 | 5/1993 |
| EP | 1 035 163 A2 | 9/2000 |

(List continued on next page.)

OTHER PUBLICATIONS

A.J.F. de Carvalho, A.A.S. Curvelo, J.A.M. Agnelli, A First Insight on Composites of Thermoplastic Starch and Kaolin, Carbohydrate Polymers 45 (2001) 189–194, received 23 Sep. 1999; revised 26(Jan. 2000) 2001 Elsevier Science Ltd.

W. John G. McCulloch, Ph. D. The History of The Development of Melt Blowing Technology, Inj Spring(1999)pp. 66–72.

Author Unknown, A New Crop of Nonwovens, Nonwovens Industry, (Feb. 2000)p. 58.

Susan Warren, Cargill, Dow Chemical to Make 'Natural Plastic', Wall Street Journal, (Jan. 11, 2000).

(List continued on next page.)

*Primary Examiner*—David Brunsman

(74) *Attorney, Agent, or Firm*—C. Brant Cook; Vladimir Vitenberg; David M. Weirich

(57) ABSTRACT

Non-thermoplastic starch fibers having no melting point and having apparent peak wet tensile stress greater than about 0.2 MegaPascals (MPa). The fibers can be manufactured from a composition comprising a modified starch and a cross-linking agent. The composition can have a shear viscosity from about 1 Pascal·Seconds to about 80 Pascal·Seconds and an apparent extensional viscosity in the range of from about 150 Pascal·Seconds to about 13,000 Pascal·Seconds. The composition can comprise from about 50% to about 75% by weight of a modified starch; from about 0.1% to about 10% by weight of an aldehyde cross-linking agent; and from about 25% to about 50% by weight of water. Prior to cross-linking, the modified starch can have a weight average molecular weight greater than about 100, 000 g/mol.

20 Claims, 5 Drawing Sheets

U.S. PATENT DOCUMENTS

| | | | | |
|---|---|---|---|---|
| 5,314,934 | A | 5/1994 | Tomka | |
| 5,316,578 | A | 5/1994 | Buehler et al. | |
| 5,346,936 | A | 9/1994 | Buehler et al. | |
| 5,362,777 | A | 11/1994 | Tomka | |
| 5,368,690 | A | 11/1994 | Solarek et al. | |
| 5,382,611 | A | 1/1995 | Stepto et al. | |
| 5,405,564 | A | 4/1995 | Stepto et al. | |
| 5,420,180 | A | 5/1995 | Katayama et al. | |
| 5,425,987 | A | 6/1995 | Shawver et al. | |
| 5,427,614 | A | 6/1995 | Wittwer et al. | |
| 5,444,113 | A | 8/1995 | Sinclair et al. | |
| 5,446,140 | A | 8/1995 | Maheras et al. | |
| 5,462,982 | A | 10/1995 | Bastioli et al. | |
| 5,476,616 | A | 12/1995 | Schwarz | |
| 5,480,923 | A | 1/1996 | Schmid et al. | |
| 5,516,815 | A | 5/1996 | Buehler et al. | |
| 5,679,145 | A | 10/1997 | Andersen et al. | |
| 5,693,279 | A | 12/1997 | Feuer et al. | |
| 5,703,160 | A | 12/1997 | Dehennau et al. | |
| 5,705,536 | A | 1/1998 | Tomka | |
| 5,720,832 | A | 2/1998 | Minto et al. | |
| 5,736,586 | A | 4/1998 | Bastioli et al. | |
| 5,773,495 | A | 6/1998 | Haschke et al. | |
| 5,844,023 | A | 12/1998 | Tomka | |
| 5,866,251 | A | 2/1999 | Bastioli et al. | |
| 5,874,486 | A | 2/1999 | Bastioli et al. | |
| 5,945,480 | A | 8/1999 | Wang et al. | |
| 6,013,223 | A | 1/2000 | Schwarz | |
| 6,045,908 | A | 4/2000 | Nakajima et al. | |
| 6,096,809 | A | 8/2000 | Lorcks et al. | |
| 6,117,925 | A | 9/2000 | Tomka | |
| 6,214,907 | B1 | 4/2001 | Tomka | |
| 6,218,321 | B1 | 4/2001 | Lorcks et al. | |
| 6,231,970 | B1 | 5/2001 | Andersen et al. | |
| 6,235,815 | B1 | 5/2001 | Loercks et al. | |
| 6,235,816 | B1 | 5/2001 | Lorcks et al. | |
| 6,235,835 | B1 | 5/2001 | Niessner et al. | |
| 6,238,520 | B1 | 5/2001 | Greenwood | |
| 6,242,102 | B1 | 6/2001 | Tomka | |
| 6,277,899 | B1 | 8/2001 | Bastioli et al. | |
| 6,302,997 | B1 | 10/2001 | Hurter et al. | |
| 6,303,000 | B1 | 10/2001 | Floyd et al. | |
| 6,365,002 | B1 | 4/2002 | Bindzus et al. | |
| 6,365,079 | B1 | 4/2002 | Winkler et al. | |
| 6,372,361 | B1 | 4/2002 | Mackewicz et al. | |
| 6,472,497 | B2 | 10/2002 | Loercks et al. | |
| 6,506,824 | B1 | 1/2003 | Bastioli et al. | |
| 6,517,678 | B1 | 2/2003 | Shannon et al. | |
| 6,723,160 | B2 * | 4/2004 | Mackey et al. | 106/206.1 |
| 2002/0015854 | A1 | 2/2002 | Billmers et al. | |
| 2002/0170693 | A1 | 11/2002 | Merrette et al. | |
| 2003/0022581 | A1 | 1/2003 | Tsai et al. | |
| 2003/0072731 | A1 | 4/2003 | Gulian et al. | |
| 2003/0099692 | A1 | 5/2003 | Lydzinski et al. | |

FOREIGN PATENT DOCUMENTS

| | | |
|---|---|---|
| EP | 1 035 239 A2 | 9/2000 |
| EP | 1 103 655 A1 | 5/2001 |
| EP | 0 722 980 B1 | 11/2001 |
| GB | 1 247 474 | 9/1971 |
| JP | 61040341 | 2/1986 |
| JP | 62028410 | 2/1987 |
| JP | 4100913 | 4/1992 |
| JP | 4146217 | 5/1992 |
| JP | 6212594 | 8/1994 |
| JP | 06-269239 | 9/1994 |
| JP | 8027627 | 1/1996 |
| JP | 8260250 | 10/1996 |
| JP | 9041224 | 2/1997 |
| JP | 9276331 | 10/1997 |
| JP | 10008364 | 1/1998 |
| WO | WO 98/40434 | 9/1998 |
| WO | WO 00/43423 | 7/2000 |
| WO | WO 01/38635 | 5/2001 |
| WO | WO 01/49912 A1 | 7/2001 |

OTHER PUBLICATIONS

Susanna Schiemer, Biodegradable Cellulose Fiber, Nonwovens World (Oct.–Nov. 1999)pp. 71–74.

H. Dale Wilson, Novel Polypropylene Resins For Nonwovens, Nonwonvens World Oct.–(Nov. 1999) p. 76.

Jan H. Schut, The New Look In Plastic–It's Paper!, Plastics Technology(Feb. 2000) pp. 52–57.

Josef L. Kokin, Lih–Shiuh Lai, Lisa L. Chedid, Effect of Starch Structure on Starch Rheological Properties, Food Technology (Jun. 1992)pp. 130–138.

Ralph D. Waniska and Marta H. Gomez, Dispersion Behavior of Starch, source unknown.

D.H. Muller, A. Krobjilowski, Meltblown Fabrics From Biodegradable Polymers, International Nonwovens Journal (Mar. 2001); abstract only.

S. Simmons et al., Thermoplastic Processing of Starch: Melt–Spinning of Starch–Based Fibers, Biodegradable Polymer Packaging (1993), Conference Proceedings, Publisher: Technomic, Lancaster, PA, pp. 171–207.

* cited by examiner

NON-THERMOPLASTIC STARCH FIBERS AND STARCH COMPOSITION FOR MAKING SAME

RELATED APPLICATIONS

This application Is a continuation of U.S. application Ser. No. 10/062,393, filed Feb. 1, 2002, now U.S. Pat. No. 6,723,160.

FIELD OF THE INVENTION

The present invention relates to non-thermoplastic fibers comprising modified starch and processes for making such fibers. The non-thermoplastic starch fibers can be used to make nonwoven webs and other disposable articles.

BACKGROUND OF THE INVENTION

Natural starch is a readily available and inexpensive material. Therefore, attempts have been made to process natural starch on standard equipment using existing technology known in the plastic industry. However, since natural starch generally has a granular structure, it needs to be "destructurized" and/or otherwise modified before it can be melt-processed like a thermoplastic material. The task of spinning starch materials to produce fine-diameter starch fibers, or more specifically, the fibers having average equivalent diameters of less than about 20 microns, suitable for production of tissue-grade fibrous webs, such as, for example, those suitable for toilet tissue, presents additional challenges. First, the processable starch composition must possess certain theological properties that allow one to effectively and economically spin fine-diameter starch fibers. Second, it is highly desirable that the resulting fibrous web, and therefore the fine-diameter starch fibers comprising such a web, possesses a sufficient wet tensile strength, flexibility, stretchability, and water-insolubility for a limited time (of use).

"Thermoplastic" or "thermoplastically-processable" starch compositions, described in several references herein below, may be suited for production of starch fibers having good stretchability and flexibility. The thermoplastic starch, however, does not possess the required wet tensile strength which is a very important quality for such consumer-disposable articles as toilet tissue, paper towel, items of feminine protection, diapers, facial tissue, and the like.

In the absence of strengthening agents, such as, for example, a high level of relatively expensive water-insoluble synthetic polymers, cross-linking may be necessary to obtain a sufficient wet tensile strength of starch fibers. At the same time, chemical or enzymatic agents have been typically used to modify or destructurize the starch to produce a thermoplastic starch composition. For example, a mix of starch and a plasticizer can be heated to a temperature sufficient to soften the resulting thermoplastic starch-plasticizer mix. In some instances pressure can be used to facilitate softening of the thermoplastic mix. Melting and disordering of the molecular structure of the starch granule takes place and a destructurized starch is obtained. However, the presence of plasticizers in the starch mix interferes with cross-linking of the starch and thus discourages the resulting starch fibers from acquiring a sufficient wet tensile strength.

Thermoplastic or thermoplastically-processable starch compositions are described in several US patents, for example: U.S. Pat. No. 5,280,055 issued Jan. 18, 1994; U.S. Pat. No. 5,314,934 issued May 24, 1994; U.S. Pat. No. 5,362,777 issued November 1994; U.S. Pat. No. 5,844,023 issued December 1998; U.S. Pat. No. 6,117,925 issued Sep. 12, 2000; U.S. Pat. No. 6,214,907 issued Apr. 10, 2001; and U.S. Pat. No. 6,242,102 issued Jun. 5, 2001, all seven immediately preceding patents issued to Tomka; U.S. Pat. No. 6,096,809 issued Aug. 1, 2000; U.S. Pat. No. 6,218,321 issued Apr. 17, 2001; U.S. Pat. No. 6,235,815 and U.S. Pat. No. 6,235,816 issued on May 22, 2001, all four immediately preceding patents issued to Lorcks et al.; U.S. Pat. No. 6,231,970 issued May 15, 2001 to Andersen et al. Generally, the thermoplastic starch composition can be manufactured by mixing starch with an additive (such as a plasticizer), preferably without the presence of water as described, for example, in U.S. Pat. No. 5,362,777 referenced herein above.

For example, U.S. Pat. Nos. 5,516,815 and 5,316,578 to Buehler et al. relate to thermoplastic starch compositions for making starch fibers from a melt-spinning process. The melted thermoplastic starch composition is extruded through a spinneret to produce filaments having diameters slightly enlarged relative to the diameter of the die orifices on the spinneret (i.e., a die swell effect). The filaments are subsequently drawn down mechanically or thermomechanically by a drawing unit to reduce the fiber diameter. The major disadvantage of the starch composition of Buehler et al. is that it requires significant amounts of water-soluble plasticizers which interfere with cross-linking reactions to generate apparent peak wet tensile stress in starch fibers.

Other thermoplastically processable starch compositions are disclosed in U.S. Pat. No. 4,900,361, issued on Aug. 8, 1989 to Sachetto et al.; U.S. Pat. No. 5,095,054, issued on Mar. 10, 1992 to Lay et al.; U.S. Pat. No. 5,736,586, issued on Apr. 7, 1998 to Bastioli et al.; and PCT publication WO 98/40434 filed by Hanna et al. published Mar. 14, 1997.

Some of the previous attempts to produce starch fibers relate principally to wet-spinning processes. For example, a starch/solvent colloidal suspension can be extruded from a spinneret into a coagulating bath. References for wet-spinning starch fibers include U.S. Pat. No. 4,139,699 issued to Hernandez et al. on Feb. 13, 1979; U.S. Pat. No. 4,853,168 issued to Eden et al. on Aug. 1, 1989; and U.S. Pat. No. 4,234,480 issued to Hernandez et al. on Jan. 6, 1981. JP 08-260,250 describes modified starch fibers manufactured from starch and an amino resin precondensate, and a method for making the same. The method includes dry spinning of an undiluted solution of starch and amino resin precondensate, followed by heat treatment. The starch used in this application is natural starch, such as contained in corn, wheat, rice, potatoes etc.

The natural starch has a high weight average molecular weight—from 30,000,000 grams per mole (g/mol) to over 100,000,000 g/mol. The melt-rheological properties of an aqueous solution comprising such starch are ill-suited for high-speed spinning processes, such as spun-bonding or melt-blowing, for production of fine-diameter starch fibers.

The art shows a need for an inexpensive and melt-processable starch composition that would allow one to produce fine-diameter starch fibers possessing good wet tensile strength properties and suitable for production of fibrous webs, particularly tissue-grade fibrous webs. Consequently, the present invention provides non-thermoplastic fine-diameter starch fibers having sufficient apparent peak wet tensile stress. The present invention further provides a process for making such non-thermoplastic starch fibers.

SUMMARY OF THE INVENTION

The invention comprises a non-thermoplastic starch fiber, wherein the fiber as a whole does not exhibit a melting point.

The fiber has an apparent peak wet tensile stress greater than about 0.2 MegaPascals (MPa), more specifically greater than about 0.5 MPa, even more specifically greater than about 1.0 MPa, more specifically greater than about 2.0 MPa, and even more specifically greater than about 3.0 MPa. The fiber has an average equivalent diameter of less than about 20 microns, more specifically less than about 10 microns, and even more specifically less than about 6 microns.

The fiber can be manufactured from a composition comprising a modified starch and a cross-linking agent. The composition can have a shear viscosity from about 1 Pascal·Seconds to about 80 Pascal·Seconds, preferably from about 3 Pascal·Seconds to about 30 Pascal·Seconds, and more preferably from about 5 Pascal·Seconds to about 20 Pascal·Seconds, as measured at a shear rate of 3,000 $sec^{-1}$ and at the processing temperature. The composition can have an apparent extensional viscosity from about 150 Pascal·Seconds to about 13,000 Pascal·Seconds, specifically from about 500 Pascal·Seconds to about 5,000 Pascal·Seconds, and more specifically from about 800 Pascal·Seconds to about 3,000 Pascal·Seconds when measured at an extension rate of about 90 $sec^{-1}$ and at the processing temperature.

The composition comprises from about 50% to about 75% by weight of a modified starch; from about 0.1% to about 10% by weight of an aldehyde cross-linking agent; and from about 25% to about 50% by weight of water. The composition can further comprise a polycationic compound selected from the group consisting of divalent or trivalent metal ion salts, natural polycationic polymers, synthetic polycationic polymers, and any combination thereof. The composition may further comprise an acid catalyst in the amount sufficient to provide a pH of the composition in the range from about 1.5 to about 5.0, and more specifically from 2.0 to about 3.0, and even more specifically from 2.2 to about 2.6. The modified starch can have a weight average molecular weight greater than about 100,000 g/mol.

The aldehyde cross-linking agent can be selected from the group consisting of formaldehyde, glyoxal, glutaraldehyde, urea glyoxal resin, urea formaldehyde resin, melamine formaldehyde resin, methylated ethylene urea glyoxal resin, and any combination thereof. The divalent or trivalent metal ion salt can be selected from the group consisting of calcium chloride, calcium nitrate, magnesium chloride, magnesium nitrate, ferric chloride, ferrous chloride, zinc chloride, zinc nitrate, aluminum sulfate, and any combination thereof. The acid catalyst can be selected from the group consisting of hydrochloric acid, sulfuric acid, phosphoric acid, citric acid, and any combination thereof.

In another aspect, the invention comprises a fiber comprising from about 50% to about 99.5% by weight of modified starch, wherein the fiber as a whole does not exhibit a melting point. The modified starch has a weight average molecular weight greater than about 100,000 (g/mol) prior to cross-linking. In one embodiment, the modified starch comprises oxidized starch.

In yet another aspect, the invention comprises a non-thermoplastic starch fiber having a salt-solution absorption capacity less than about 2 grams of salt solution per 1 gram of fiber, more specifically less than about 1 gram of salt solution per 1 gram of fiber, and still more specifically less than about 0.5 gram of salt solution per 1 gram of fiber.

DETAILED DESCRIPTION OF THE INVENTION

Figure 1:
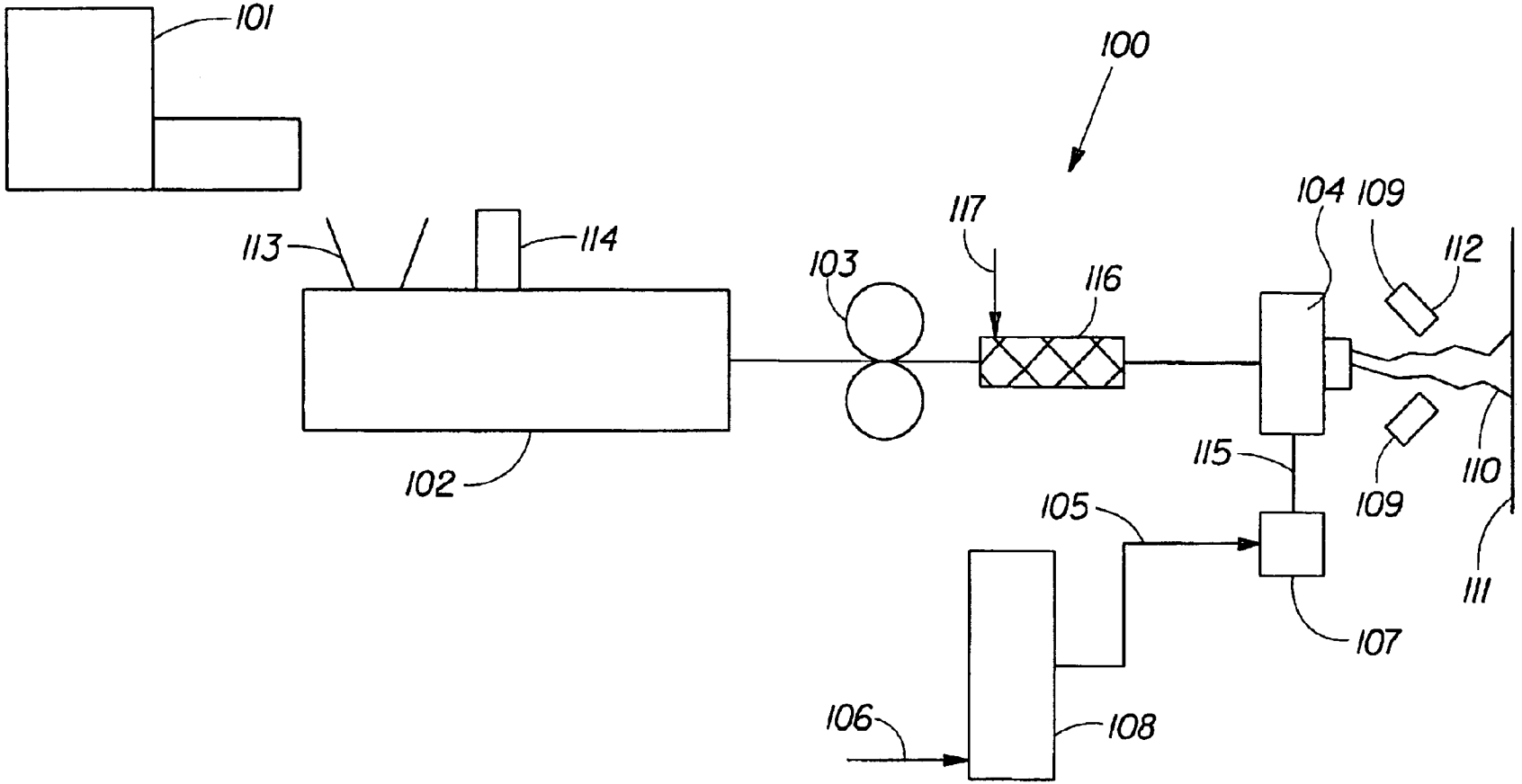
FIG. 1 is a schematic side view of the process of the present invention.

As used herein, the following terms have the following meanings.

"Non-thermoplastic starch composition" is a material comprising starch and requiring water to soften to such a degree that the material can be brought into a flowing state, which can be shaped as desired, and more specifically, processed (for example, by spinning) to form a plurality of non-thermoplastic starch fibers suitable for forming a flexible fibrous structure. The non-thermoplastic starch composition cannot be brought into a required flowing state by the influence of elevated temperatures alone. While the non-thermoplastic starch composition may include some amounts of other components, such as, for example, plasticizers, that can facilitate flowing of the non-thermoplastic composition, these amounts by themselves are not sufficient to bring the non-thermoplastic starch composition as a whole into a flowing state in which it can be processed to form suitable non-thermoplastic fibers. The non-thermoplastic starch composition also differs from a thermoplastic composition in that once the non-thermoplastic composition is dewatered, for example, by drying, to comprise a solidified state, it loses its "thermoplastic" qualities. When the composition comprises a cross-linker, the dewatered composition becomes, in effect, a cross-linked thermosetting composition. A product, such as, for example, a plurality of fibers made of such a non-thermoplastic starch composition, does not, as a whole, exhibit a melting point and does not, as a whole, have a melting temperature (characteristic of thermoplastic compositions); instead, the non-thermoplastic starch product, as a whole, decomposes without ever reaching a flowing state as its temperature increases to a certain degree ("decomposition temperature"). In contrast, a thermoplastic composition retains its thermoplastic qualities regardless of the presence and absence of water therein and can reach its melting point ("melting temperature") and become flowable as its temperature increases.

"Non-thermoplastic starch fiber" is a fiber manufactured from the non-thermoplastic starch composition. Typically, but not necessarily, the non-thermoplastic starch fiber comprises a thin, slender, and flexible structure. The non-thermoplastic starch fiber does not exhibit a melting point and decomposes as the temperature rises, without reaching a flowable state, i.e., the state in which the fiber as a whole melts and flows so that it loses its "fiber" characteristics, such as fiber integrity, dimensions (diameter and length), etc. The expression "as a whole" in the present context is meant to emphasize that the fiber as an integrated element (as opposed to its separate chemical components) is under consideration. It should be recognized that certain amounts of flowable substances, such as, for example, plasticizers, may be present in the non-thermoplastic fibers and may exhibit certain "flowing". Yet, the non-thermoplastic fiber as a whole would not lose its fiber characteristics even if some of its components may flow.

"Fine-diameter" starch fiber is a non-thermoplastic starch fiber having an average equivalent diameter less than about 20 microns, and more specifically less than about 10 microns.

"Equivalent diameter" is used herein to define a cross-sectional area of an individual non-thermoplastic fiber of the present invention, which cross-sectional area is perpendicular to the longitudinal axis of the fiber, regardless of whether this cross-sectional area is circular or non-circular. A cross-sectional area of any geometrical shape can be defined according to the formula: $S=\frac{1}{4}\pi D^2$, where S is the area of any geometrical shape, $\pi=3.14159$, and D is the equivalent diameter. Using a hypothetical example, the fiber's cross-sectional area S of 0.005 square microns having a rectangular shape can be expressed as an equivalent circular area of 0.005 square microns, wherein the circular area has a diameter "D." Then, the diameter D can be calculated from the formula: $S=\frac{1}{4}\pi D^2$, where S is the known area of the rectangle. In the foregoing example, the diameter D is the equivalent diameter of the hypothetical rectangular cross-section. Of course, the equivalent diameter of the fiber having a circular cross-section is this circular cross-section's real diameter. "Average" equivalent diameter is an equivalent diameter computed as an arithmetic average of the actual fiber's diameter measured with an optical microscope at at least 3 positions of the fiber along the fiber's length.

"Modified starch" is a starch that has been modified chemically or enzymatically. The modified starch is contrasted with a native starch, which is a starch that has not been modified, chemically or otherwise, in any way.

"Poly-functional chemical cross-linking reactive agents" are chemical substances that have two or more chemical functional groups capable of reacting with hydroxy- or carboxy-functional groups of starch. The term "poly-functional chemical cross-linking reactive agents" includes di-functional chemical reactive agents.

"Embryonic non-thermoplastic starch fibers" or simply "embryonic fibers" are non-thermoplastic starch fibers being manufactured at the earliest phase of their formation, existing primarily within an attenuation zone. As the embryonic fibers attenuate and are thereafter dewatered, they become non-thermoplastic fibers of the present invention. Because the embryonic fibers are an earlier phase of the resultant non-thermoplastic starch fibers being made, for reader's convenience, the embryonic fibers and the non-thermoplastic fibers are designated by the same numerical reference 110.

Figure 9:
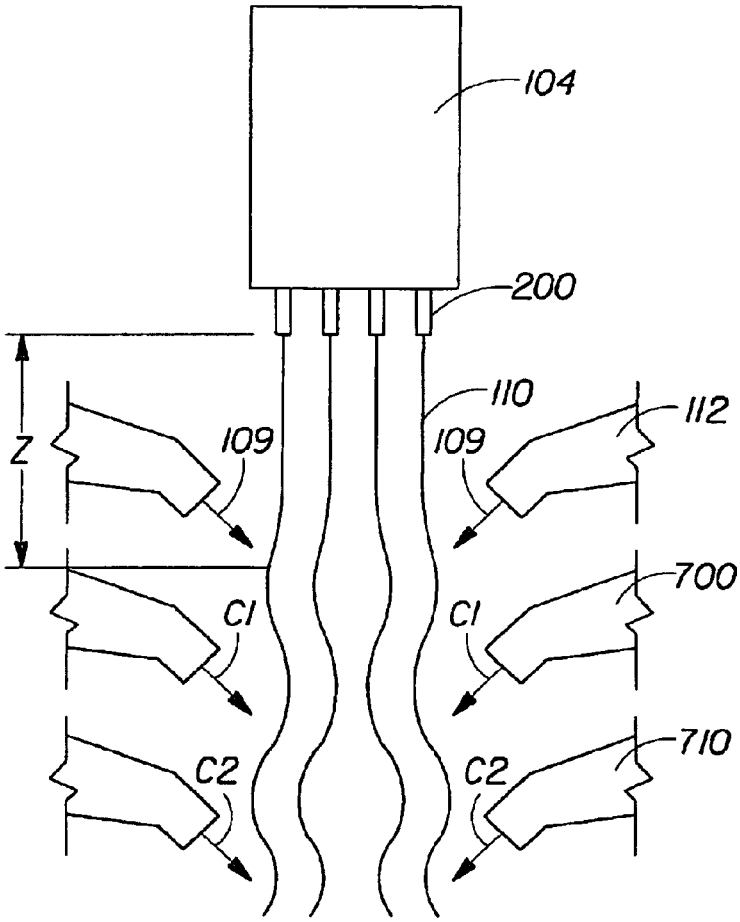
FIG. 9 is a schematic partial side view of the process of the present invention.

"Attenuation zone" is a three-dimensional space outlined by an area formed by an overall shape of a plurality of extrusion nozzles in plane view (FIGS. 3–6) and extending to an attenuation distance Z (FIGS. 2 and 9) from the nozzle tips in a general direction of the movement of the fibers being made. The "attenuation distance" is a distance that starts at the extrusion nozzle tips and extends in the general direction of the movement of the fibers being made, and within which distance the non-thermoplastic embryonic fibers being produced are capable of attenuating to form resultant non-thermoplastic fibers having individual average equivalent diameters of less than about 20 microns.

"Processing Temperature" means the temperature of the non-thermoplastic starch composition, at which temperature the non-thermoplastic starch composition of the present invention can be processed to form embryonic non-thermoplastic starch fibers. The processing temperature can be from 50° C. to 95° C. as measured at the extrusion nozzle tips.

"Salt-solution absorption capacity" of a starch sample is a ratio of grams of salt solution absorbed by a starch sample per grams of starch sample, as described in TEST METHODS AND EXAMPLES below.

"Apparent Peak Wet Tensile Stress," or simply "Wet Tensile Stress," is a condition existing within a non-thermoplastic starch fiber at the point of its maximum (i.e., "peak") stress as a result of strain by external forces, and more specifically elongation forces, as described in TEST METHODS AND EXAMPLES below. The stress is "apparent" because a change, if any, in the fiber's diameter resulting from the fiber's elongation, is not taken into consideration for the purposes of the test. The apparent peak wet tensile stress of the non-thermoplastic fibers is proportional to their wet tensile strength and is used herein to quantitatively estimate the latter.

Non-thermoplastic starch fibers 110 (FIGS. 1, 7–9, and 10) of the present invention can be produced from a composition comprising a modified starch and a cross-linking agent. In one aspect, the composition may comprise from about 50% to about 75% by weight of modified starch, from about 0.1% to about 10% by weight of an aldehyde cross-linking agent, and from about 25% to about 50% by weight of water. Such a composition can beneficially have a shear viscosity from about 1 Pascal·Seconds (Pa·s) to about 80 Pa·s, as measured at a shear rate of 3,000 $sec^{-1}$ and at the processing temperature. More specifically the non-thermoplastic starch composition herein may comprise from about 50% to about 75% by weight of the modified starch. The composition may further have an apparent extensional viscosity from about 150 Pa·s to about 13,000 Pa·s, as measured at an extension rate of about 90 $sec^{-1}$ and the processing temperature. The extensional viscosity and the shear viscosity can be measured according to TEST METHODS described herein.

The composition can further comprise a polycationic compound selected from the group consisting of divalent or trivalent metal ion salts, natural polycationic polymers, synthetic polycationic polymers, and any combination thereof. The polycationic compound may comprise from about 0.1% to about 15% by weight. The composition may further comprise an acid catalyst in the amount sufficient to provide a pH of the composition in the range from about 1.5 to about 5.0, more specifically from about 2.0 to about 3.0, and even more specifically from about 2.2 to about 2.6. The modified starch comprising the composition can have a weight average molecular weight greater than about 100,000 (g/mol).

A natural starch can be modified chemically or enzymatically, as well known in the art. For example, the natural starch can be acid-thinned, hydroxy-ethylated or hydroxy-propylated or oxidized. Though all starches are potentially useful herein, the present invention can be beneficially practiced with high amylopectin natural starches derived from agricultural sources, which offer the advantages of being abundant in supply, easily replenishable and inexpensive. Chemical modifications of starch typically include acid or alkali hydrolysis and oxidative chain scission to reduce molecular weight and molecular weight distribution. Suitable compounds for chemical modification of starch include organic acids such as citric acid, acetic acid, glycolic acid, and adipic acid; inorganic acids such as hydrochloric acid, sulfuric acid, nitric acid, phosphoric acid, boric acid, and partial salts of polybasic acids, e.g., $KH_2PO_4$, $NaHSO_4$; group Ia or IIa metal hydroxides such as sodium hydroxide, and potassium hydroxide; ammonia; oxidizing agents such as hydrogen peroxide, benzoyl peroxide, ammonium persulfate, potassium permanganate, hypochloric salts, and the like; and mixtures thereof.

Chemical modifications may also include derivatization of starch by reaction of its OH groups with alkylene oxides, and other ether-, ester-, urethane-, carbamate-, or isocyanate-forming substances. Hydroxyalkyl, acetyl, or carbamate starches or mixtures thereof can be used as chemically modified starches. The degree of substitution of the chemically modified starch is from 0.05 to 3.0, and more specifically from 0.05 to 0.2. Biological modifications of starch may include bacterial digestion of the carbohydrate bonds, or enzymatic hydrolysis using enzymes such as amylase, amylopectase, and the like.

Generally, all kinds of natural starches can be used in the present invention. Suitable naturally occurring starches can include, but are not limited to: corn starch, potato starch, sweet potato starch, wheat starch, sago palm starch, tapioca starch, rice starch, soybean starch, arrow root starch, amioca starch, bracken starch, lotus starch, waxy maize starch, and high amylose corn starch. Naturally occurring starches, particularly corn starch and wheat starch, can be particularly beneficial due to their low cost and availability.

The cross-linking agent that can be used in the present invention comprises a poly-functional chemical reactive agent capable of reacting with hydroxy-functional groups or carboxy functional groups of the modified starch. Cross-linking agents used in the paper industry to cross-link wood pulp fibers are generally termed "wet-strength resins." These wet-strength resins can be also useful in cross-linking starch-based materials. A general dissertation on the types of wet-strength resins utilized in the paper-making art can be found in TAPPI monograph series No. 29, Wet Strength in Paper and Paperboard, Technical Association of the Pulp and Paper Industry (New York, 1965), which is incorporated herein by reference for the purpose of describing the types of wet-strength resins utilized in the paper industry. Polyamide-epichlorohydrin resins are cationic polyamide amine-epichlorohydrin wet-strength resins that have been found to be of particular utility. Suitable types of such resins are described in U.S. Pat. Nos. 3,700,623, issued on Oct. 24, 1972, and U.S. Pat. No. 3,772,076, issued on Nov. 13, 1973, both issued to Keim and both being hereby incorporated by reference herein for the purpose of describing types of the wet-strength resins that can be used in the present invention. One commercial source of a useful polyamide-epichlorohydrin resin is Hercules Inc. of Wilmington, Del., which markets such resins under the name Kymene®.

Glyoxylated polyacrylamide resins have also been found to be of utility as wet-strength resins. These resins are described in U.S. Pat. Nos. 3,556,932, issued on Jan. 19, 1971, to Coscia, et al. and U.S. Pat. No. 3,556,933, issued on Jan. 19, 1971, to Williams et al., both patents being incorporated herein by reference for the purpose of describing types of the wet-strength resins that can be used in the present invention. One commercial source of glyoxylated polyacrylamide resins is Cytec Co. of Stanford, Conn., which markets one such resin under the name Parez® 631 NC.

It has been found that when suitable cross-linking agent such as Parez® 631NC is added to the starch composition of the present invention under acidic condition, non-thermoplastic starch fibers produced from the non-thermoplastic starch composition have a significant wet tensile strength that can be appreciated by testing the fibers' apparent peak wet tensile stress, as described below. Consequently, products, such as, for example, fibrous webs suitable for consumer-disposable items, produced with the non-thermoplastic starch fibers of the present invention will also have a significant apparent peak wet tensile stress.

Other water-soluble resins finding utility in this invention may include formaldehyde, glyoxal, glutaraldehyde, urea glyoxal resin, urea formaldehyde resin, melamine formaldehyde resin, methylated ethylene urea glyoxal resin, and other glyoxal based resins, and any combination thereof. Polyethylenimine type resins may also find utility in the present invention. In addition, temporary wet-strength resins such as Caldas® 10 (manufactured by Japan Carlit) and CoBond® 1000 (manufactured by National Starch and Chemical Company) may be used in the present invention.

Still other cross-linking agents finding utility in this invention include divinyl sulphone, anhydride containing copolymers, such as styrene-maleic anhydride copolymers, dichloroacetone, dimethylolurea, diepoxides such as bisepoxybutane or bis(glycidyl ether), epichlorohydrin, and diisocyanates.

In addition to cross-linking agents which react covalently with starch hydroxy and carboxy functional groups, divalent and trivalent metal ions are useful in the present invention for cross-linking starch by formation of metal ion complexes with carboxy functional groups on starch. In particular, oxidized starches, which have increased levels of carboxy functional groups, can be cross-linked well with divalent and trivalent metal ions. In addition to polycationic metal ions, polycationic polymers from either natural or synthetic sources are also useful for cross-linking starch by formation of ion pair complexes with carboxy functional groups on starch to form insoluble complexes commonly termed "coacervates." Metal ion cross-linking has been found to be particularly effective when used in combination with covalent cross-linking reagents. For the present invention, a suitable cross-linking agent can be added to the composition in quantities ranging from about 0.1% by weight to about 10% by weight, more typically from about 0.1% by weight to about 3% by weight.

Natural, unmodified starch generally has a very high weight average molecular weight and a broad molecular weight distribution, e.g. natural corn starch has a weight average molecular weight greater than about 40,000,000 g/mol. Therefore, natural, unmodified starch does not have the inherent theological properties suitable for use in high speed solution spinning processes such as spunbonding or meltblowing nonwoven processes which are capable of producing fine-diameter fibers. These small diameters are very beneficial in achieving sufficient softness and opacity of the end product—important functional properties for a variety of consumer disposable products, such as, for example, toilet tissue, wipes, diapers, napkins, and disposable towels.

In order to generate the required theological properties for high-speed spinning processes, the molecular weight of the natural, unumodified starch must be reduced. The optimum molecular weight is dependent on the type of starch used. For example, a starch with a low level of amylose component, such as a waxy maize starch, disperses rather easily in an aqueous solution with the application of heat and does not retrograde or recrystallize significantly. With these properties, a waxy maize starch can be used at a relatively high weight average molecular weight, for example in the range of 500,000 g/mol to 5,000,000 g/mol. Modified starches such as hydroxy-ethylated Dent corn starch, which contains about 25% amylose, or oxidized Dent corn starch tend to retrograde more than waxy maize starch but less than acid thinned starch. This retrogradation, or recrystallization, acts as a physical cross-linking to effectively raise the weight average molecular weight of the starch in aqueous solution. Therefore, an appropriate weight average molecular weight for hydroxy-ethylated Dent corn starch or oxidized Dent corn starch is from about 200,000 g/mol to about 1,000,000 g/mol. For acid thinned Dent corn starch, which tends to retrograde more than oxidized Dent corn starch, the appropriate weight average molecular weight is from about 100,000 g/mol to about 500,000 g/mol.

The average molecular weight of starch can be reduced to the desirable range for the present invention by chain scission (oxidative or enzymatic), hydrolysis (acid or alkaline catalyzed), physical/mechanical degradation (e.g., via the thermomechanical energy input of the processing equipment), or combinations thereof The thermomechanical method and the oxidation method offer an additional advantage in that they are capable of being carried out in situ of the melt-spinning process. It is believed the non-thermoplastic fibers of the present invention may contain from about 50% to about 99.5% by weight of modified starch.

The natural starch can be hydrolyzed in the presence of an acid catalyst to reduce the molecular weight and molecular weight distribution of the composition. The acid catalyst can be selected from the group consisting of hydrochloric acid, sulfuric acid, phosphoric acid, citric acid, and any combination thereof. Also, a chain scission agent may be incorporated into a spinnable starch composition such that the chain scission reaction takes place substantially concurrently with the blending of the starch with other components. Non-limiting examples of oxidative chain scission agents suitable for use herein include ammonium persulfate, hydrogen peroxide, hypochlorite salts, potassium permanganate, and mixtures thereof Typically, the chain scission agent is added in an amount effective to reduce the weight average molecular weight of the starch to the desirable range. It is found that compositions having modified starches in the suitable weight average molecular weight ranges have suitable shear viscosities, and thus improve processability of the composition. The improved processability is evident in less interruptions of the process (e.g., reduced breakage, shots, defects, hang-ups) and better surface appearance and strength properties of the final product, such as fibers of the present invention.

The divalent or trivalent metal ion salt can comprise any water-soluble divalent or trivalent metal ion salt and can be selected from the group consisting of calcium chloride, calcium nitrate, magnesium chloride, magnesium nitrate, ferric chloride, ferrous chloride, zinc chloride, zinc nitrate, aluminum sulfate, ammonium zirconium carbonate, and any combination thereof The polycationic polymer can comprise any water-soluble polycationic polymer such as, for example, polyethyleneimine, quaternized polyacrylamide polymer such as Cypro® 514 manufactured by Cytec Industries, Inc, West Patterson, N.J., or natural polycationic polymers such as chitosan, and any combination thereof.

According to the present invention, the non-thermoplastic starch fibers have wet tensile stress greater than about 0.2 MegaPascals (MPa), more specifically greater than about 0.5 MPa, still more specifically greater than about 1.0 MPa, and even more specifically greater than about 2.0 MPa, and yet even more specifically greater than about 3.0 MPa. In some embodiments the non-thermoplastic starch fibers can have wet tensile stress greater than about 3.0 MPa. Not wishing to be bound by theory, we believe that generation of wet tensile strength in the non-thermoplastic starch fibers of the present invention can be achieved by reducing the weight average molecular weight of the starch to allow production of a non-thermoplastic starch composition having appropriate theological properties for high-speed solution spinning of fine-diameter non-thermoplastic starch fibers, followed by cross-linking of the starch in the fibers being formed. Cross-linking increases molecular weight of the starch in the fibers being formed, thereby facilitating fibers' water-insolubility, which in turn results in a high wet tensile strength of the resultant non-thermoplastic starch fibers.

Extensional, or elongational, viscosity ($\eta_e$) relates to extensibility of the non-thermoplastic starch composition and can be particularly important for extensional processes such as fiber-making. The extensional viscosity includes three types of deformation: uniaxial or simple extensional viscosity, biaxial extensional viscosity, and pure shear extensional viscosity. The uniaxial extensional viscosity is important for uniaxial extensional processes such as fiber spinning, melt blowing, and spun bonding.

The Trouton ratio (Tr) can be used to express extensional flow behavior of the starch composition of the present invention. The Trouton ratio is defined as the ratio between the extensional viscosity ($\eta_e$) and the shear viscosity ($\eta_s$), $$Tr=\eta_e(\epsilon^o, t)/\eta_s$$

wherein the extensional viscosity $\eta_e$ is dependent on the deformation rate ($\epsilon^o$) and time (t). For a Newtonian fluid, the uniaxial extension Trouton ratio has a constant value of 3. For a non-Newtonian fluid, such as the starch compositions herein, the extensional viscosity is dependent on the deformation rate ($\epsilon^o$) and time (t). It has also been found that processable compositions of the present invention typically have a Trouton ratio of at least about 3. Trouton ratio may range from about 5 to about 1,000, specifically from about 30 to about 300, and more specifically from about 50 to about 200, when measured at the processing temperature and 90 $sec^{-1}$ extension rate.

The non-thermoplastic fibers of the present invention may find use in a variety of consumer-disposable articles such as nonwovens suitable for webs for tissue grades of paper such as those used in the production of toilet paper, paper towel, napkins and facial tissue toilet paper, diapers, items of feminine protection and incontinence articles, and the like. In addition, these fibers can be used in filters for air, oil and water, vacuum-cleaner filters, furnace filters, face masks, coffee filters, tea or coffee bags, thermal insulation materials and sound insulation materials, biodegradable textile fabrics for improved moisture absorption and softness of wear such as microfiber or breathable fabrics, an electrostatically charged, structured web for collecting and removing dust, reinforcements and webs for hard grades of paper, such as wrapping paper, writing paper, newsprint, corrugated paper board, medical uses such as surgical drapes, wound dressing, bandages, dermal patches and selfdissolving sutures; and dental uses such as dental floss and toothbrush bristles. The non-thermoplastic starch fibers or fibrous webs manufactured therefrom may also be incorporated into other materials such as saw dust, wood pulp, plastics, and concrete, to form composite materials, which can be used as building materials such as walls, support beams, pressed boards, dry wall and backings, and ceiling tiles; other medical uses such as casts, splints, and tongue depressors; and in fireplace logs for decorative and/or burning purpose.

A process of making non-thermoplastic fibers according to the present invention comprises the following steps.

First, a non-thermoplastic starch composition comprising from about 50% to about 75% by weight of modified starch and from about 25% to about 50% by weight of water is provided. In some embodiments, the step of providing the non-thermoplastic starch composition can be preceded by the steps of preparing the non-thermoplastic starch composition.

Figure 2:
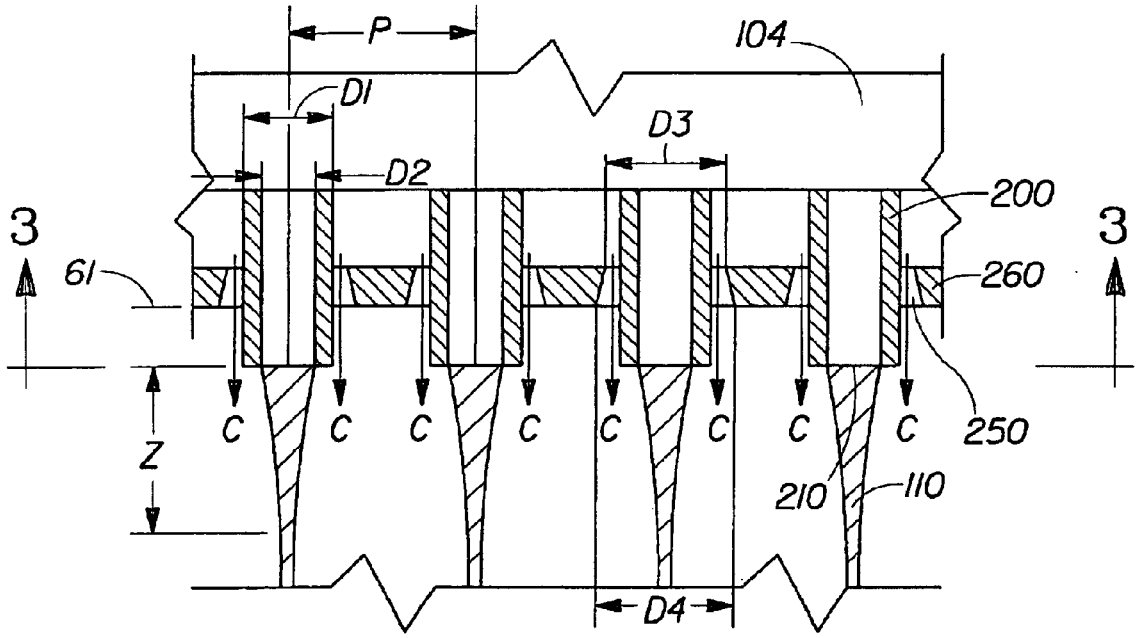
FIG. 2 is a schematic partial side view of the process of the present invention, showing an attenuation zone.
Figure 3:
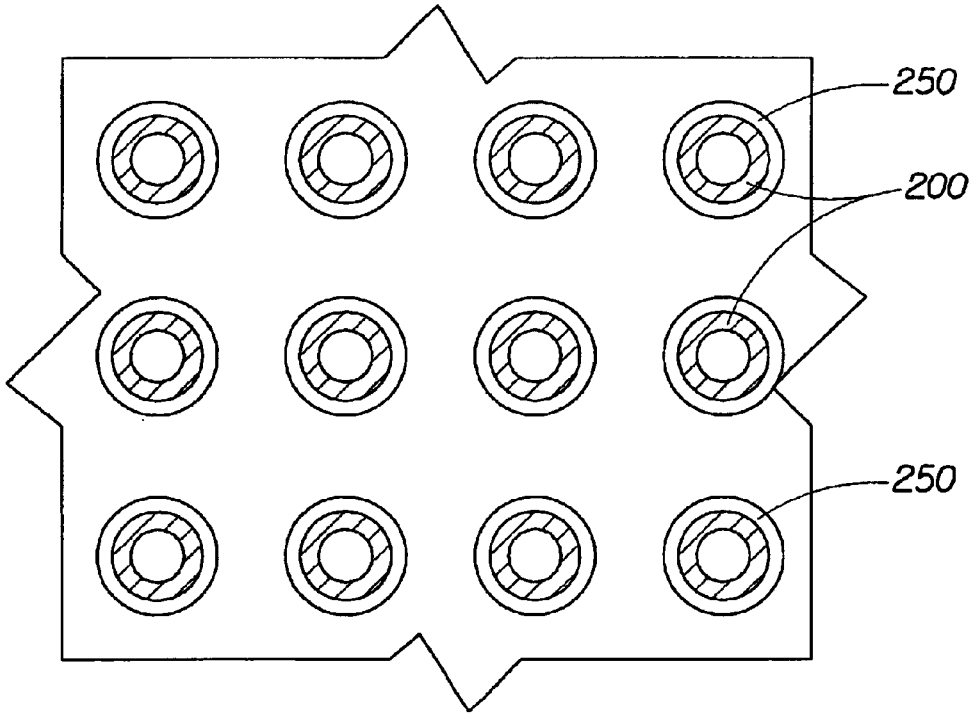
FIG. 3 is a schematic plan view taken along lines 3—3 of FIG. 2 and showing one possible arrangement of a plurality of extrusion nozzles arranged to provide non-thermoplastic starch fibers.

Referring now to FIGS. 1–9, the non-thermoplastic fibers 110 of the present invention can be manufactured using a process comprising the steps of extruding the non-thermoplastic starch composition through a plurality of nozzles 200, thereby forming a plurality of embryonic fibers; attenuating the embryonic fibers with a high velocity attenuating air (a direction of the attenuating air is schematically shown by arrows C in FIG. 2) so that the resulting nonthermoplastic fibers 110 have average individual equivalent diameters less than about 20 microns, and dewatering the fibers 110 to a consistency from about 70% to about 99% by weight. According to the invention, he fibers may have individual average equivalent diameters of less than about 20 microns, more specifically less than about 10 microns, and even more specifically less than about 6 microns.

According to the present invention, the resulting individual non-thermoplastic fibers 110 comprise from about 50% to about 99.5% by weight of modified (such as, for example, oxidized) starch and, as a whole, do not have a melting point, as described above in detail.

For the purposes of producing the fine-diameter non-thermoplastic fibers 110 of the present invention, the desired attenuation beneficially occurs when the composition has a suitable shear viscosity in the range of from about 1 Pascal·second (Pa·s) to about 80 Pa·s, more specifically from about 3 Pa·s to about 30 Pa·s, and even more specifically from about 5 to about 20 Pa·s, as measured at the processing temperature and shear rate of 3,000 $sec^{-1}$. A step of maintaining the suitable shear viscosity in the suitable range can be beneficially complemented by humidifying the attenuation zone and/or at least partially isolating the attenuation zone from the surrounding environment. It is beneficial to provide the attenuating air having a relative humidity greater than about 50%, so that the relative humidity of the air in the attenuation zone can be greater than about 50%, specifically greater than about 60%, and more specifically, greater than about 70%, as measured at the extrusion nozzle tips according to a method described below.

Figure 4:
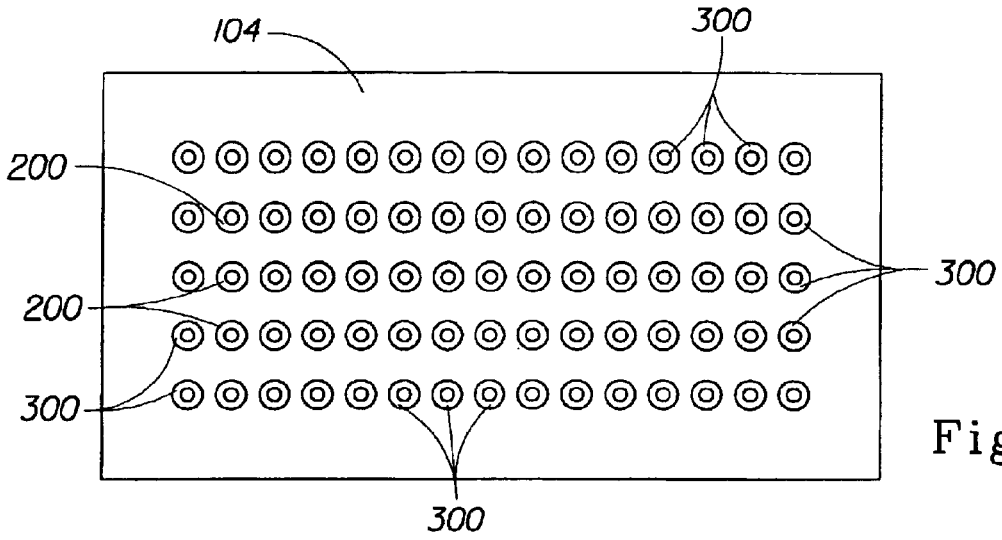
FIG. 4 is a view similar to that of FIG. 3 and showing one possible arrangement of orifices for providing a boundary air around the attenuation zone.
Figure 5:
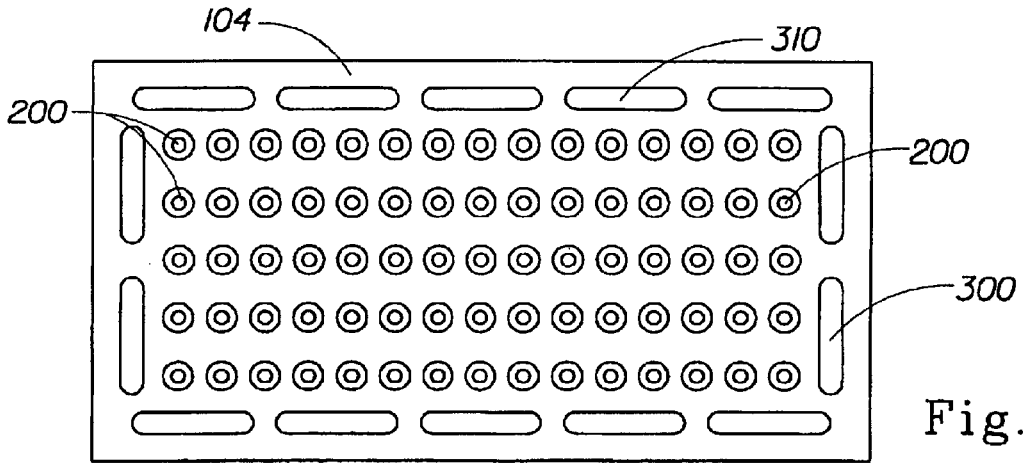
FIG. 5 is a view similar to that of FIG. 3 and showing another possible arrangement of orifices for providing a boundary air around the attenuation zone.
Figure 6:
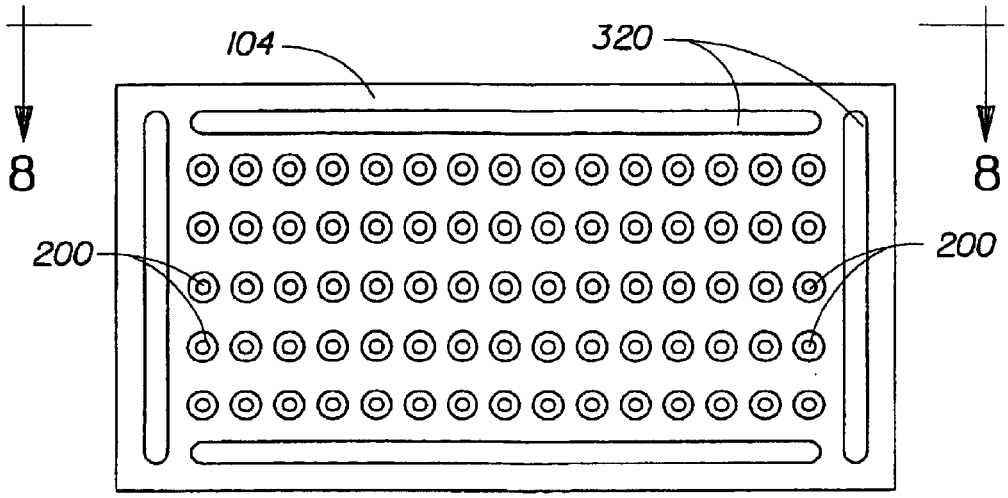
FIG. 6 is a view similar to that of FIG. 3 and showing still another possible arrangement of orifices for providing a boundary air around the attenuation zone.
Figure 7:
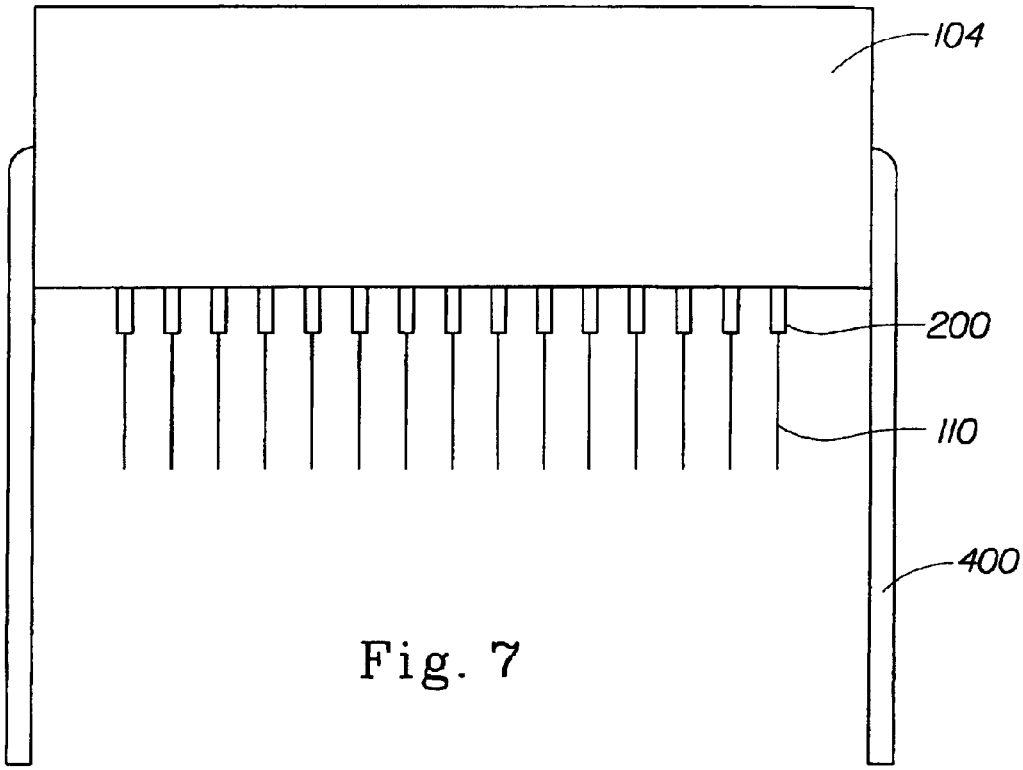
FIG. 7 is a schematic side view of the attenuation zone enclosed by physical walls.
Figure 8:
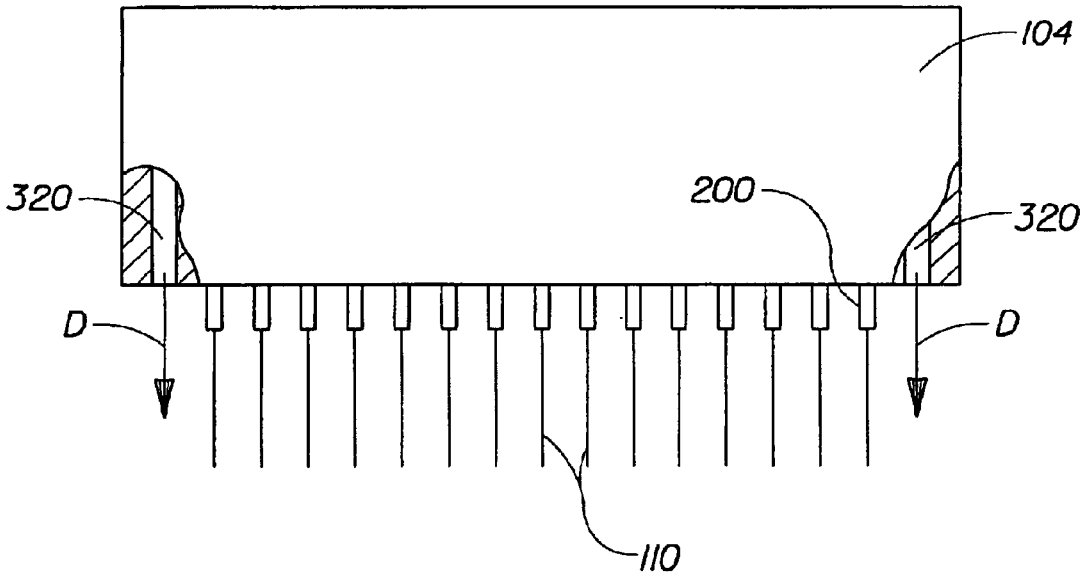
FIG. 8 is a schematic side view taken along lines 8—8 of FIG. 6.

A means for maintaining a desired humidity in the attenuation zone can include, for example, providing an enclosure of the attenuation zone. In FIG. 7, the attenuation zone is at least partially enclosed by walls 400. Alternatively or additionally, the attenuation zone can be at least partially isolated by a boundary air (arrows D in FIG. 8) that can be provided around the attenuation zone. The boundary air can be supplied through a plurality of discrete orifices 300 (FIG. 4), or slots (FIG. 5) surrounding the plurality of nozzles 200, as viewed in plan view. In FIG. 6, the boundary air is supplied through continuous slots 320 outlining an outer perimeter of the attenuation zone. Other means of maintaining a desired humidity in the attenuation zone may include providing steam or spraying water into the attenuation zone (not shown). The boundary air can be supplied externally, i.e. independently from the die (not shown), or alternatively or additionally, internally, i.e. through the die (FIGS. 4–6). Beneficially, the boundary air can be humidified to have a relative humidity of greater than about 50%. A velocity of the boundary air can be substantially equal to the velocity of the attenuation air.

It is believed that in the process of the present invention, the attenuation distance Z can be less than about 250 millimeters (about 10 inches), more specifically less than about 150 millimeters (about 6 inches), and even more specifically less than 100 millimeters (about 4 inches). One skilled in the art will appreciate that due to the nature of the process, the exact dimensions of the attenuation distance may not be readily ascertainable. Also, a rate of the attenuation of the fibers may vary within the attenuation zone, e.g., the attenuation rate is believed to gradually decline towards the end of the attenuation zone.

For the purposes of production of a fibrous web, the plurality of extrusion nozzles 200 can be beneficially arranged in multiple rows, as best shown in FIGS. 3–6. The attenuation air can be supplied through a plurality of discrete circular orifices 250 surrounding the extrusion nozzles 200, FIG. 3. Principally, such an arrangement is described in U.S. Pat. No. 5,476,616 issued on Dec. 19, 1995 and U.S. Pat. No. 6,013,223 issued on January 2000, both to Schwarz, which patents are incorporated herein by reference for the purpose of showing an arrangement of the apparatus comprising multiple rows of individual extrusion nozzles, each surrounded by a circular air orifice. Both of the Schwarz patents are concerned with processing thermoplastic materials. It has been found that in order to form the non-thermoplastic fibers of the present invention, the attenuating air can have an average velocity greater than about 30 m/sec, more specifically from about 30 m/sec to about 500 m/sec, as measured at the nozzle tips according to a method described herein. One skilled in the art will recognize that a specially designed (such as converging-diverging) nozzle geometry may be required to attain supersonic speed.

The step of dewatering the non-thermoplastic fibers being formed can be accomplished by providing a hot drying air 109 downstream of the attenuation zone, supplied by drying nozzles 112 (FIG. 9), wherein the drying air has a temperature from about 150° C. to about 480° C., and more specifically from about 200° C. to about 320° C., and a relative humidity of less than about 10%.

In some embodiments, a secondary attenuating air (arrows C1 in FIG. 9) can be beneficially provided, for example, downstream of the attenuating air. The secondary attenuating air applies additional longitudinal force to the fibers, thereby further attenuating the fibers being made. It should be noted that while the secondary attenuating air can contact the fibers downstream of the attenuation zone, this secondary force primarily affects those portions of the embryonic fibers that are still in the attenuation zone. The secondary attenuating air can have a temperature from about 20° C. to about 480° C., and more specifically from about 70° C. to about 320° C. A velocity of the secondary attenuating air can be from about 30 m/sec to about 500 m/sec, and more specifically from about 50 m/sec to about 350 m/sec, as measured at the secondary attenuating air nozzle exit, a minimal distance (of about 3 mm) from a tip of a secondary attenuating air jet outlet 700, FIG. 9. The secondary attenuating air can be dry air or, alternatively, humidified air.

If desired, the secondary attenuating air can be applied at multiple positions downstream of the extrusion nozzles. For example, in FIG. 9, the secondary attenuating air comprises air C1 supplied through the secondary-attenuating-air jet outlet 700 and air C2 supplied through a secondary-attenuating-air jet outlet 710 downstream of the air C1. The secondary attenuating air can be applied at an angle less than 60 degrees, and more specifically from about 5 to about 45 degrees, relative to the general direction of the fibers being formed.

The resultant non-thermoplastic starch fibers can be collected on a working surface, or a collection device, 111 (FIG. 1), such as, for example, a foraminous belt, for further processing.

TEST METHODS AND EXAMPLES

(A) Apparent Peak Wet Tensile Stress

The following test has been designed to measure the apparent peak wet tensile stress of a starch fiber during the first minutes of the fiber being moistened—to reflect a consumer's real-life expectations as to the strength properties of the end product, such as, for example, a toilet tissue, during its use.

(A)(1) Equipment

Sunbeam® ultrasonic humidifier, Model 696-12, manufactured by Sunbeam Household Products Co. of McMinnville, Tenn., USA. The humidifier has an on/off switch and is operated at room temperature. A 27-inch length of 0.625" OD 0.25" ID rubber hose was attached to an output. When operating correctly, the humidifier will output between 0.54 and 0.66 grams of water per minute as a mist.

The water droplet velocity and the water droplet diameter of the mist generated by the humidifier can be measured using photogrammetric techniques. Images can be captured using a Nikon®D, Model D1, of Japan, 3-megapixel digital camera equipped with a 37 mm coupling ring, a Nikon® PB-6 bellows, and a Nikon® auto-focus AF Micro Nikkor® 200 mm 1:4D lens. Each pixel had the dimension of about 3.5 micrometer assuming a square pixel. Images can be taken in shadow mode using a Nano Twin Flash (High-Speed Photo-Systeme, of Wedel, Germany). Any number of commercially available image-processing packages can be used to process the images. The dwell time between the two flashes of this system is set at 5, 10, and 20 microsecond. The distance traveled by water droplets between flashes is used to calculate droplet velocity.

Water droplets were found to be from about 12 microns to about 25 microns in diameter. The velocity of the water droplets at a distance of about (25±5) mm from the outlet of the flexible hose was calculated to be about 27 meters per second (m/sec), ranging from about 15 m/sec to about 50 m/sec. Obviously, as the mist stream encountered room air, the velocity of the water droplets slows with increasing distance from the hose exit due to drag forces.

The flexible hose is positioned so that the mist stream totally engulfs the fiber thereby thoroughly wetting the fiber. To ensure that the fiber is not damaged or broken by the mist stream, the distance between the outlet of the flexible hose and the fiber is adjusted until the mist stream stalls at or just past the fiber.

Filament Stretching Rheometer (FSR) with 1-gram Force Transducer, Model 405A, manufactured by Aurora Scientific Inc., of Aurora, Ontario, Canada, equipped with small metal hook. Initial instrument settings are:

| | |
|---|---|
| initial gap = 0.1 cm | strain rate = 0.1 $s^{-1}$ |
| Hencky strain limit = 4 | data points per second = 25 |
| post move time = 0 | |

FSR is based on a design similar to that described in an article titled "A Filament Stretching Device For Measurement Of Extensional Viscosity," published by J. Rheology 37 (6), 1993, pages 1081–1102 (Tirtaatmadja and Sridhar), incorporated herein by reference, with the following modifications:

(a) FSR is oriented so that the two end plates can move in a vertical direction.

(b) FSR comprises two independent ball screw linear actuators, Model PAG001 (manufactured by Industrial Device Corp. of Petaluma, Calif., USA), each actuator driven by a stepper motor (for example, Zeta® 83–135, manufactured by Parker Hannifin Corp., Compumotor Division, Rohnert Park, Calif., USA). One of the motors can be equipped with an encoder (for example, Model E151000C865, manufactured by Dynapar Brand, Danaher Controls of Gurnee, Ill, USA) to track the position of the actuator. The two actuators can be programmed to move equal distances at equal speeds in opposite directions.

(c) The maximal distance between the end plates is approximately 813 mm (about 32 inches).

A wide-bandwidth single-channel signal-conditioning module, Model 5B41-06, manufactured by Analog Devices Co. of Norwood, Mass., USA can be used to condition the signal from the force transducer, Model 405A, manufactured by Aurora Scientific Inc., of Aurora, Ontario, Canada.

(B) Example(s) of Non-Thermoplastic Fibers, Process for Making Same, and Test Methods for Measuring Apparent Peak Wet Tensile Stress, Shear Viscosity, and Extensional Viscosity (B)(1) Process for Making Non-Thermoplastic Starch Fibers Fibers were formed by means of a small-scale apparatus, a schematic representation of which is shown in FIG. 1. Referring to FIG. 1, apparatus 100 consisted of a volumetric feeder 101 with a capability to provide at least 12 grams per minute (g/min) of starch composition to an 18-mm co-rotating twin-screw extruder 102 manufactured by American Leistritz Extruder Co. of New Jersey, USA. The temperature of the extruder barrel segments is controlled by heating coils and water jackets (not shown) to provide appropriate temperatures to destructurize the starch with water. Dry starch powder was added in a hopper 113 and deionized water was added at a port 114.

The pump 103 used was a Zenith®, type PEP II, having a capacity of 0.6 cubic centimeters per revolution (cc/rev), manufactured by Parker Hannifin Corporation, Zenith Pumps division, of Sanford, N.C., USA. The starch flow to a die 104 was controlled by adjusting the number of revolutions per minute (rpm) of the pump 103. Pipes connecting the extruder 102, the pump 103, the mixer 116, and the die 104 were electrically heated and thermostatically controlled to be maintained at about 90° C.

The die 104 had several rows of circular extrusion nozzles spaced from one another at a pitch P (FIG. 2) of about 1.524 millimeters (about 0.060 inches). The nozzles had individual inner diameters D2 of about 0.305 millimeters (about 0.012 inches) and individual outside diameters (D1) of about 0.813 millimeters (about 0.032 inches). Each individual nozzle was encircled by an annular and divergently flared orifice 250 formed in a plate 260 (FIG. 2) having a thickness of about 1.9 millimeters (about 0.075 inches). A pattern of a plurality of the divergently flared orifices 250 in the plate 260 corresponded to a pattern of extrusion nozzles 200. The orifices 250 had a larger diameter D4 (FIG. 2) of about 1.372 millimeters (about 0.054 inches) and a smaller diameter D3 of 1.17 millimeters (about 0.046 inches) for attenuation air. The plate 260 was fixed so that the embryonic fibers 110 being extruded through the nozzles 200 were surrounded and attenuated by generally cylindrical, humidified air streams supplied through the orifices 250. The nozzles can extend to a distance from about 1.5 mm to about 4 mm, and more specifically from about 2 mm to about 3 mm, beyond a surface 261 of the plate 260 (FIG. 2). A plurality of boundary-air orifices 300 (FIG. 4), was formed by plugging nozzles of two outside rows on each side of the plurality of nozzles, as viewed in plane, so that each of the boundary-layer orifice comprised a annular aperture 250 described herein above.

Attenuation air can be provided by heating compressed air from a source 106 by an electrical-resistance heater 108, for example, a heater manufactured by Chromalox, Division of Emerson Electric, of Pittsburgh, Pa., USA. An appropriate quantity of steam 105 at an absolute pressure of from about 240 to about 420 kiloPascals (kPa), controlled by a globe valve (not shown), was added to saturate or nearly saturate the heated air at the conditions in the electrically heated, thermostatically controlled delivery pipe 115. Condensate was removed in an electrically heated, thermostatically controlled, separator 107. The attenuating air had an absolute pressure from about 130 kPa to about 310 kPa, measured in the pipe 115.

A cross-linking solution comprising a cross-linking agent, such as, for example, Parez® 490 and an acid catalyst, can be prepared off-line and supplied through a pipe 116 to a static mixer 117, such as, for example, SMX-style static mixer manufactured by Koch Chemical Corporation of Witchita, Kans., USA.

The non-thermoplastic embryonic fibers 110 being extruded had a moisture content of from about 25% to about 50% by weight. The embryonic fibers 110 were dried by a drying air stream 109 having a temperature from about 149° C. (about 300° F.) to about 315° C. (about 600°F.) by an electrical resistance heater (not shown) supplied through drying nozzles 112 and discharged at an angle from about 40 to about 50 degrees relative to the general orientation of the non-thermoplastic embryonic fibers being extruded. The embryonic fibers dried from about 25% moisture content to about 5% moisture content (i.e., from a consistency of about 75% to a consistency of about 95%) were collected on a collection device 111, such as, for example, a movable foraminous belt.

(B)(2) Example 1 of Non-Thermoplastic Fibers and Method for Determining Wet Tensile Stress Thereof Twenty five grams of StaCote® H44 starch (oxidized waxy maize starch with a weight average molecular weight of approximately 500,000 g/mol, from A. E. Staley Manufacturing Corporation of Decatur, Ill., USA, 1.25 grams of anhydrous calcium chloride (5% based on the weight of the starch), 1.66 grams of Parez® 490 from Bayer Corp., Pittsburgh, Pa., USA, (3% urea-glyoxal resin based on the weight of the starch), and 45 grams of aqueous 0.1 M potassium phosphate buffer (pH=2.1) were added to a 200 ml beaker. A beaker was disposed in a water bath to boil for approximately one hour while the starch mix was stirred manually to destructurize the starch and to evaporate the amount of water until about 25 grams of water remain in the breaker. Then the mixture was cooled to a temperature of about 40° C. A portion of the mixture was transferred to a 10 cubic centimeters (cc) syringe and extruded therefrom to form a fiber. The fiber was manually elongated so that the fiber had a diameter between about 10 microns and about 100 microns. Then, the fiber was suspended in an ambient air for approximately one minute to allow the fiber to dry and solidify. The fiber was placed on an aluminum pan and cured in a convection oven for about 10 minutes at a temperature of about 120° C. The cured fiber was then placed in a room having a constant temperature of about 22° C. and a constant relative humidity of about 25% for about 24 hours.

Figure 10:
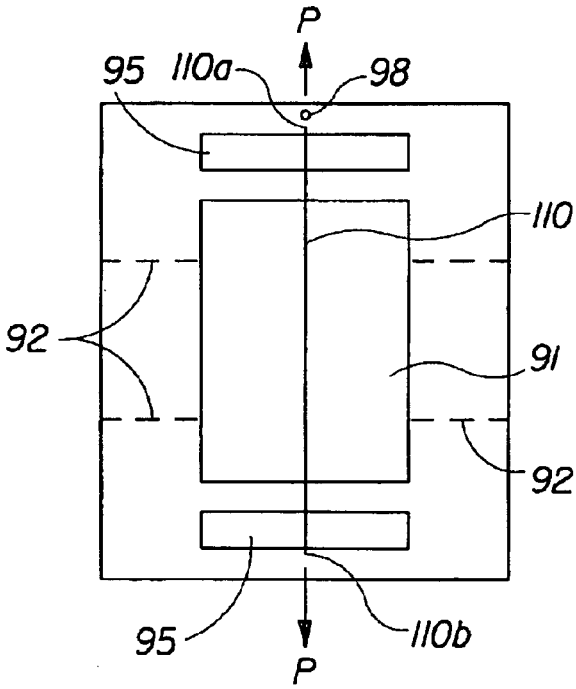
FIG. 10 is a schematic plan view of a coupon that can be used for determining wet tensile stress of fibers according to the present invention.

Since the single fibers are fragile, a coupon 90 (FIG. 10) can be used to support the fiber 110. The coupon 90 can be manufactured from an ordinary office copy paper or a similar light material. In an illustrative example of FIG. 10, the coupon 90 comprises a rectangular structure having the overall size of about 20 millimeters by about 8 millimeters, with a rectangle cutout 91 sized about 9 millimeters by about 5 millimeters in the center of the coupon 90. The ends 110*a*, 110*b* of the fiber 110 can be secured to the ends of the coupon 90 with an adhesive tape 95 (such as, for example, a conventional Scotch tape), or otherwise, so that the fiber 110 spans the distance (of about 9 millimeters in the instant example) of the cut-out 91 in the center of the coupon 90, as shown in FIG. 10. For convenience of mounting, the coupon 90 may have a hole 98 in the top portion of the coupon 90, structured to receive a suitable hook mounted on the upper plate of the force transducer. Prior to applying a force to the fiber, the fiber's diameter can be measured with an optical microscope at 3 positions and averaged to obtain the average fiber diameter used in calculations.

The coupon 90 can then be mounted onto a fiber-stretching rheometer (not shown) so that the fiber 110 is substantially parallel to the direction of the load "P" (FIG. 10) to be applied. Side portions of the coupon 90 that are parallel to the fiber 110 can be cut (along lines 92, FIG. 10), so that the fiber 110 is the only element receiving the load.

Then the fiber 110 can be sufficiently moistened. For example, an ultrasonic humidifier (not shown) can be turned on, with a rubber hose positioned about 200 millimeters (about 8 inches) away from the fiber so as to direct the output mist directly at the fiber. The fiber 110 can be exposed to the vapor for about one minute, after which the force load P can be applied to the fiber 110. The fiber 110 continues to be exposed to the vapor during the application of the force load that imparts elongation force to the fiber 110. Care should be taken to ensure that the fiber 110 is continuously within the main stream of the humidifier output as the force is applied to the fiber. When correctly exposed, droplets of water are typically visible on or around the fiber 110. The humidifier, its contents, and the fiber 110 are allowed to equilibrate to an ambient temperature before use.

Using the force load and diameter measurements, the wet tensile stress can be calculated in units of MegaPascals (MPa). The test can be repeated multiple times, for example eight times. The results of wet tensile stress measurements of eight fibers are averaged. The force readings from the force transducer are corrected for the mass of the residual coupon by subtracting the average force transducer signal collected after the fiber had broken from the entire set of force readings. The stress at failure for the fiber can be calculated by taking the maximum force generated on the fiber divided by the cross-sectional area of the fiber based on the optical microscope measurements of the fiber's average equivalent diameter measured prior to conducting the test. The actual beginning plate separation (bps) can be dependent on a particular sample tested, but is recorded in order to calculate the actual engineering strain of the sample. In the instant example, the resulting average wet tensile stress of 0.33 MPa, with the standard deviation of 0.29, was obtained.

(B)(3) Example 2 of Non-Thermoplastic Fibers

Twenty five grams of Clinton® 480 starch (oxidized Dent corn starch having a weight average molecular weight of approximately 740,000 g/mol) from Archer, Daniels, Midland Co., Decatur, Ill., USA, 1.25 grams of anhydrous calcium chloride (5% based on the weight of the starch), 1.66 grams of Parez® 490 (3% urea-glyoxal resin based on the weight of the starch), and 45 grams of aqueous 0.5% w/w citric acid solution were added to a 200 ml beaker. The fibers were produced and prepared according to the procedure outlined in the Example 1 above, and the wet tensile stress of the fibers was then determined by the method described in Example 1. The resulting average wet tensile stress of 2.1 MPa with a standard deviation of 1.25 was obtained, with a maximum wet tensile stress of 3.4 MPa.

(B)(4) Example 3 of Non-Thermoplastic Fibers

Twenty five grams of Ethylex® 2005 starch (hydroxyethylated Dent corn starch with 2% weight-to-weight substitution of ethylene oxide and with a weight average molecular weight of approximately 250,000 g/mol from A. E. Staley Manufacturing Corporation, 5.55 grams of Parez® 490 (10%/o urea-glyoxal resin based on the weight of the starch), 2.0 grams of a 1.0% w/w solution of N-300 polyacrylamide from Cytec Industries, Inc., West Patterson, N.J., USA, and 45 grams of aqueous 0.5% w/w citric acid solution were added to a 200 ml beaker. The fibers were produced and prepared according to the procedure outlined in the example 1 above, and the wet tensile stress of the fibers was then determined by the method described in Example 1. The resulting average wet tensile stress of 0.45 MPa with a standard deviation of 0.28 was obtained.

While the method for determining the wet tensile stress of a single fiber described above provides a direct measurement of an important fiber performance property, this measurement can be time consuming. Another method that can be used to measure the extent of cross-linking of the fiber and thus its tensile strength is a method for measuring a salt-solution absorption by the fiber. The method is based on the fact that the cross-linked starch, when placed in a water or salt solution, absorbs water in such a solution. A measurable change in solution concentration is the result of solution absorption by the starch fiber. High levels of fiber cross-linking decrease an absorption capacity of the fiber.

The following method uses a Blue Dextran® solution. The Blue Dextran® molecules are large enough so that they do not penetrate into starch fibers or particles, while water molecules do penetrate and are absorbed by the starch fiber. Therefore, as a result of water absorption by the starch fiber, the Blue Dextran® is concentrated in the solution and can be measured precisely using an optical absorbance measurement.

A Blue Dextran® solution can be prepared by dissolving 0.3 gram of Blue Dextran® (from Sigma, St. Louis, Mo.) in 100 milliliters of distilled water. A 20 milliliter aliquot of the Blue Dextran® solution is mixed with 80 milliliters of a salt solution. The salt solution was prepared by mixing 10 grams of sodium chloride, 0.3 gram calcium chloride dihydrate, and 0.6 gram magnesium chloride hexahydrate in a 1.0 liter flask and bringing it to the full volume with distilled water.

The optical absorbance of the Blue Dextran®/salt solution (a blank or baseline measurement) can be measured using a standard one-centimeter cuvette at 617 nanometers wavelength with a DR/4000U UV/VIS Spectrophotometer, manufactured by HACH Company, Loveland, Colo., USA.

A film of starch is prepared by "destructurizing" starch by heating 25 grams of starch with 25 grams of distilled water for approximately one hour in a glass beaker in a water bath which has been heated to 95° C. After the starch has been destructurized, Parez® 490 cross-linker and phosphoric acid catalyst are added to the starch mixture and the mixture is stirred. The mixture is poured onto a one foot square sheet of Teflon® material and spread to form a film. The film is allowed to dry at a room temperature for one day and is then cured in an oven at about 120° C. for ten minutes.

The dried film is broken and placed in an IKA All Basic grinder, manufactured by IKA Works, Inc., of Wilmington, N.C., USA, and ground at 25,000 rpm for approximately one minute. The ground starch is then sieved through a 600-micron sieve, for example, a Sieve Number 30, manufactured by U.S. Standard Sieve Series, A.S.T.M E-11 Specifications, manufactured by Dual Mfg. Co., Chicago, Ill., USA, onto a 300 micron sieve (Sieve Number 50).

Two grams of the sieved starch is added to 15 grams of the Blue Dextran®/salt solution which is stirred continuously at room temperature for about 15 minutes in a covered beaker to prevent evaporation. The solution is then filtered through a 5-micrometer syringe filter, for example, Spartan®-25 nylon membrane filter from Schleicher & Schuell Co., of Keene, N.H., USA). The absorbance of the filtered solution can be measured, similarly to the Blue Dextran®/salt blank measurement. Salt-solution absorption capacity of a starch sample can be expressed as a ratio of grams of salt solution absorbed (GA) per gram of starch sample (GS) and is calculated by the following formula:

$$GA/GS=(15-((\text{Absorbance of blank}/\text{absorbance of sample})\times 15))/2$$

The non-thermoplastic starch fibers can be tested by the salt solution absorption capacity test by substituting the fibers for the starch particles. According to the present invention, the non-thermoplastic starch fiber can have the salt-solution absorption capacity less than about 2 grams of salt solution per 1 gram of fiber, more specifically less than about 1 gram of salt solution per 1 gram of fiber, and still more specifically less than about 0.5 gram of salt solution per 1 gram of fiber.

EXAMPLE

Sieved particles of the following starches were prepared and measured according to the method described immediately above. Each of the starch samples, comprising Parez® 490 crosslinker, phosphoric acid catalyst, and optionally calcium chloride crosslinker, all on an active solids basis, are listed in the following table along with solution absorption values.

| Starch Type | % Parez 490 | % phosphoric acid | % calcium chloride | Gram solution absorbed per gram starch |
|---|---|---|---|---|
| Ethylex ® 2005 | 1.0 | 0.75 | 0 | 0.47 |
| StaCote ® H44 | 1.0 | 0.75 | 5.0 | 1.23 |
| Purity ® Gum | 1.0 | 0.75 | 0 | 2.27 |

-continued

| Starch Type | % Parez 490 | % phosphoric acid | % calcium chloride | Gram solution absorbed per gram starch |
|---|---|---|---|---|
| ClearCote ® 615 | 1.0 | 0.75 | 0 | 1.45 |
| Clinton ® 480 | 5.0 | 0.75 | 5.0 | 1.02 |
| Ethylex ® 2005 | 5.0 | 0.75 | 0 | 0.38 |
| StaCote ® H44 | 5.0 | 0.75 | 5.0 | 0.84 |

(C) Shear Viscosity

The shear viscosity of the non-thermoplastic starch composition of the present invention can be measured using a capillary rheometer, Model Rheograph 2003, manufactured by Goettfert USA of Rock Hill S.C., USA. The measurements can be conducted using a capillary die having a diameter D of 1.0 mm and a length L of 30 mm (i.e., L/D=30). The die can be attached to the lower end of the rheometer's barrel, which is held at a test temperature (t) ranging from about 25° C. to about 90° C. A sample composition can be preheated to the test temperature and loaded into the barrel section of the rheometer, to substantially fill the barrel (about 60 grams of sample is used). The barrel is held at the specified test temperature (t).

If, after the loading, air bubbles to the surface, compaction prior to running the test can be used to rid the sample of the entrapped air. A piston can be programmed to push the sample from the barrel through the capillary die at a set of chosen rates. As the sample goes from the barrel through the capillary die, the sample experiences a pressure drop. An apparent shear viscosity can be calculated from the pressure drop and the flow rate of the sample through the capillary die. Then log (apparent shear viscosity) can be plotted against log (shear rate) and the plot can be fitted by the power law, according to the formula $\eta=K\gamma^{n-1}$, wherein K is a material constant, and $\gamma$ is the shear rate. The reported apparent shear viscosity of the composition herein is an extrapolation to a shear rate of 3,000 $sec^{-1}$ using the power law relation.

(D) Extensional Viscosity

The extensional viscosity of the non-thermoplastic composition of the present invention can be measured using a capillary rheometer, Model Rheograph 2003, manufactured by Goettfert USA. The measurements can be conducted using a semi-hyperbolic die design with an initial equivalent diameter $D_{Initial}$ of 15 mm, a final equivalent diameter ($D_{final}$) of 0.75 mm and a length L of 7.5 mm.

The semi-hyperbolic shape of the die is defined by two equations. Where Z is the axial distance from the initial equivalent diameter, and D(z) is the equivalent diameter of the die at distance z from $D_{initial}$;

$$Z_n = (L+1)^{\frac{(n-1)}{n_{total}}} - 1$$

$$D(Z_n) = \sqrt{\frac{(D_{initial}^2)}{\left[1 + \frac{Z_n}{L} \cdot \left[\left(\frac{D_{initial}}{D_{final}}\right)^2 - 1\right]\right]}}$$

The die can be attached to the lower end of the barrel, which is held at a fixed test temperature t of about 75° C., roughly corresponding to the temperature at which the non-thermoplastic starch composition is to be processed. The sample starch composition can be preheated to the die temperature and loaded into the barrel of the rheometer, to substantially fill the barrel. If, after the loading, air bubbles to the surface, compaction can be used prior to running the test to rid the molten sample of the entrapped air. A piston can be programmed to push the sample from the barrel through the hyperbolic die at a chosen rate. As the sample goes from the barrel through the orifice die, the sample experiences a pressure drop. An apparent extensional viscosity can be calculated from the pressure drop and the flow rate of the sample through the die according to the following equation:

$$\text{Apparent Extensional Viscosity} = (\text{delta } P/\text{extension rate}/E_h)\times 10^5,$$

where apparent extensional viscosity, i.e., the extensional viscosity not corrected for shear viscosity effects, is in Pascal·seconds (Pa·s), delta P is the pressure drop in bars, extension rate is the flow rate of the sample through the die in units of $sec^{-1}$, and $E_h$ is dimensionless Hencky strain. Hencky strain is the time- or history-dependent strain. The strain experienced by a fluid element in a non-Newtonian fluid is dependent on its kinematic history, that is $$\varepsilon = \int_0^t \varepsilon^o(t')\,\partial t'$$

The Hencky Strain $E_h$ for this die design is 5.99, defined by the equation;

$$E_h = \ln[(D_{initial}/D_{final})^2]$$

The apparent extensional viscosity can be reported as a function of extension rate at 90 $sec^{-1}$ using the power law relation. Detailed disclosure of extensional viscosity measurements using a semi-hyperbolic die can be found in U.S. Pat. No. 5,357,784, issued Oct. 25, 1994 to Collier, the disclosure of which is incorporated herein by reference for the limited purpose of describing the extensional viscosity measurements.

(E) Molecular Weight

The weight average molecular weight (Mw) of the non-thermoplastic starch can be determined by Gel Permeation Chromatography (GPC) using a mixed bed column. Components of a high performance liquid chromatograph (HPLC) are as follows:

| | |
|---|---|
| Pump: | Millenium ®, Model 600E, manufactured by Waters Corporation of Milford, MA, USA. |
| System controller: | Waters Model 600E |
| Autosampler: | Waters Model 717 Plus |
| Injection Volume: | 200 μL |
| Column: | PL gel 20 μm Mixed A column (gel molecular weight ranges from 1,000 g/mol to 40,000,000 g/mol) having a length of 600 mm and an internal diameter of 7.5 mm. |
| Guard Column: | PL gel 20 μm, 50 mm length, 7.5 mm ID |
| Column Heater: | CHM-009246, manufactured by Waters Corporation. |
| Column Temperature: | 55° C. |
| Detector: | DAWN ® Enhanced Optical System (EOS), manufactured by Wyatt Technology of Santa Barbara, CA, USA, laser-light scattering detector with K5 cell and |

-continued

| | |
|---|---|
| | 690 nm laser. Gain on odd numbered detectors set at 101. Gain on even numbered detectors set to 20.9. Wyatt Technology's Optilab ® differential refractometer set at 50° C. Gain set at 10. |
| Mobile Phase: | HPLC grade dimethylsulfoxide with 0.1% w/v LiBr |
| Mobile Phase Flow Rate: | 1 mL/min, isocratic |
| GPC Control Software: | Millennium ® (R) software, Version 3.2, manufactured by Waters Corporation. |
| Detector Software: | Wyatt Technology's Astra ® software, Version 4.73.04 |
| Run Time: | 30 minutes |

The starch samples can be prepared by dissolving the starch into the mobile phase at nominally 3 mg of starch/1 mL of mobile phase. The sample can be capped and then stirred for about 5 minutes using a magnetic stirrer. The sample can then be placed in an 85° C. convection oven for about 60 minutes. The sample then can be allowed to cool undisturbed to a room temperature. The sample can then be filtered through a 5 μm syringe filter (for example, through a 5 μm Nylon membrane, type Spartan-25, manufactured by Schleicher & Schuell, of Keene, N.H., US), into a 5 milliliters (mL) autosampler vial using a 5 mL syringe.

For each series of samples measured, a blank sample of solvent can be injected onto the column. Then a check sample can be prepared in a manner similar to that related to the samples described above. The check sample comprises 2 mg/mL of pullulan (Polymer Laboratories) having a weight average molecular weight of 47,300 g/mol. The check sample can be analyzed prior to analyzing each set of samples. Tests on the blank sample, check sample, and non-thermoplastic starch test samples can be run in duplicate. The final run can be a third run of the blank sample. The light scattering detector and differential refractometer can be run in accordance with the "Dawn EOS Light Scattering Instrument Hardware Manual" and "Optilab® DSP Interferometric Refractometer Hardware Manual," both manufactured by Wyatt Technology Corp., of Santa Barbara, Calif., USA, and both incorporated herein by reference.

The weight average molecular weight of the sample is calculated using the Astra® software, manufactured by Wyatt Technology Corp. A dn/dc (differential change of refractive index with concentration) value of 0.066 is used. The baselines for laser light detectors and the refractive index detector are corrected to remove the contributions from the detector dark current and solvent scattering. If a laser light detector signal is saturated or shows excessive noise, it is not used in the calculation of the molecular mass. The regions for the molecular weight characterization are selected such that both the signals for the 90° detector for the laser-light scattering and refractive index are greater than 3 times their respective baseline noise levels. Typically the high molecular weight side of the chromatogram is limited by the refractive index signal and the low molecular weight side is limited by the laser light signal.

The weight average molecular weight can be calculated using a "first order Zimm plot" as defined in the Astra® software. If the weight average molecular weight of the sample is greater than 1,000,000 g/mol, both the first and second order Zimm plots are calculated, and the result with the least error from a regression fit is used to calculate the molecular mass. The reported weight average molecular weight is the average of the two runs of the sample.

(F) Relative Humidity

Relative humidity can be measured using wet and dry bulb temperature measurements and an associated psychometric chart. Wet bulb temperature measurements are made by placing a cotton sock around the bulb of a thermometer. Then the thermometer, covered with the cotton sock, is placed in hot water until the water temperature is higher than an anticipated wet bulb temperature, more specifically, higher than about 82° C. (about 180° F.). The thermometer is placed in the attenuating air stream, at about 3 millimeters (about ⅛ inch) from the extrusion nozzle tips. The temperature will initially drop as the water evaporates from the sock. The temperature will plateau at the wet bulb temperature and then will begin to climb once the sock loses its remaining water. The plateau temperature is the wet bulb temperature. If the temperature does not decrease, then the water must be heated to a higher temperature. The dry bulb temperature is measured using a 1.6 mm diameter J-type thermocouple placed at about 3 mm downstream from the extrusion nozzle tip.

Based on a standard atmospheric psychometric chart or an Excel plug-in, such as for example, "MoistAirTab" manufactured by ChemicaLogic Corporation, a relative humidity can be determined. Relative Humidity can be read off the chart, based on the wet and dry bulb temperatures.

(G) Air Velocity

A standard Pitot tube can be used to measure the air velocity. The Pitot tube is aimed into the air stream, producing a dynamic pressure reading from an associated pressure gauge. The dynamic pressure reading, plus a dry bulb temperature reading is used with the standard formulas to generate an air velocity. A 1.24 mm (0.049 inches) Pitot tube, manufactured by United Sensor Company of Amherst, N.H., USA, can be connected to a hand-held digital differential pressure gauge (manometer) for the velocity measurements.

(H) Fiber Diameter

Fiber diameter can be measured according to the following procedure. A rectangular sample is cut from the web manufactured from the non-thermoplastic starch fibers. The sample is cut to a size to fit on glass microscope slides, each having a size of about 6.35 millimeters (about 0.25 inch) by about 25.4 millimeter (about 1 inch), and is sandwiched between the two slides. The two slides are clamped together with binder clips to flatten-out the sample. The sample and slides are placed on the microscope stage, set up with a 10× objective lens. An Olympus® BHS microscope, commercially available from the Fryer Company of Cincinnati, Ohio, USA, can be used. The microscope light-collimating lens is moved as far from the objective lens as possible. A picture of the slide can be captured on a digital camera, such as, for example, Nikon® D1 digital camera, and the resulting TIFF-format file can be transferred to a computer, for example, by using Nikon®, Capture Software, Version 1.1. The TIFF file can loaded into an image analysis software package Optimus®, Version 6.5, manufactured by Media Cybernetics Inc. of Silver Spring, Md., USA. The proper calibration file is selected for the specified microscope and objective. The Optimus® software is used to manually select and measure the diameter of the fibers. At least thirty, preferably non-entangled, fibers showing on a computer screen arc measured in Optimus® using a length-measurement tool. These fiber diameters can then be averaged to produce an average fiber diameter for a given sample. Prior to this analysis, a spatial calibration can be done to obtain the fiber diameters, with proper scaling and units, as one skilled in the art will recognize.

The examples listed in Table below were produced using the equipment described herein above, FIGS. 1 and 2. A Purity Gum® 59, (from National Starch & Chemical Company, Bridgewater, N.J. USA), solution with water was prepared in the extruder and fed to the die. The solution contained about 65% starch and 35% water.

A pair of drying ducts was used in each case. The drying ducts were positioned symmetrically about the spinning fiber path. The drying ducts were angled so that the drying air stream impinged upon the fiber stream.

TABLE

| Sample | Units | A | B | C |
|---|---|---|---|---|
| Attenuation Air Flow Rate | g/min | 375 | 375 | 364 |
| Attenuation Air Temperature | ° C. | 40 | 40 | 95 |
| Attenuation Steam Flow Rate | g/min | 140 | 140 | 106 |
| Attenuation Steam Gage Pressure | kPa | 220 | 220 | 290 |
| Attenuation Gage Pressure in Delivery Pipe | kPa | 126 | 126 | 180 |
| Attenuation Exit Temperature | ° C. | 80 | 80 | 77.8 |
| Solution Pump Speed | revs/min | 20 | 10 | 20 |
| Solution Flow | g/min/hole | 0.66 | 0.33 | 0.66 |
| Drying Air Flow Rate | g/min | 972 | 972 | 910 |
| Air Duct Type | | Slots | Slots | Windjet ® |
| Air Duct Dimensions | mm | 51 × 5 | 51 × 5 | model specific |
| Velocity via Pitot-Static Tube | m/s | 34 | 34 | 304 |
| Drying Air Temperature at Heater | ° C. | 260 | 260 | 260 |
| Dry Duct Position from Die | mm | 125 | 125 | 150 |
| Drying Duct Angle Relative to Fibers | degrees | 45 | 45 | 45 |
| Average Fiber Diameter | microns | 13.6 | 8.2 | 10.1 |

Example A yielded fibers having an average equivalent diameter of about 14 microns. Example B involved a change in a non-thermoplastic solution flow rate to a lower value. This condition yielded a smaller average equivalent fiber diameter of about 8 microns. Example C involved a secondary high-speed attenuation air. In Example C, Windjet®, Model Y727-AL, air nozzles from Spraying System Co., Wheaton, Ill. USA, were used for the drying air to produce higher air velocities.

What is claimed is:

1. A consumer-disposable article comprising a non-thermoplastic starch fiber having an apparent peak wet tensile stress greater than about 0.2 MegaPascals (MPa), wherein the non-thermoplastic starch fiber as a whole has no melting point.

2. The consumer-disposable article according to claim 1, wherein the apparent peak wet tensile stress of the fiber is greater than about 0.5 MPa.

3. The consumer-disposable article according to claim 1, wherein the apparent peak wet tensile stress of the fiber is greater than about 1.0 MPa.

4. The consumer-disposable article according to claim 1, wherein the apparent peak wet tensile stress of the fiber is greater than about 2.0 MPa.

5. The consumer-disposable article according to claim 1, wherein the apparent peak wet tensile stress of the fiber is greater than about 3.0 MPa.

6. The consumer-disposable article according to claim 1, wherein the fiber is manufactured from a composition comprising a modified starch and a cross-linking agent.

7. The consumer-disposable article according to claim 6, wherein the composition comprises from about 50% to about 75% by weight of a modified starch; from about 0.1% to about 10% by weight of an aldehyde cross-linking agent; and from about 25% to about 50% of water; wherein the composition has a shear viscosity from about 1 Pascal·Seconds to about 80 Pascal·Seconds measured at the processing temperature and at a shear rate of 3000 $sec^{-1}$.

8. The consumer-disposable article according to claim 7, wherein the aldehyde cross-linking agent is selected from the group consisting of formaldehyde, glyoxal, glutaraldehyde, urea glyoxal resin, urea formaldehyde resin, melamine formaldehyde resin, methylated ethylene urea glyoxal resin, and any combination thereof.

9. The consumer-disposable article according to claim 6, wherein the composition further comprises from about 0.1% to about 15% by weight of a polycationic compound selected from the group consisting of divalent or trivalent metal ion salts, natural polycationic polymers, synthetic polycationic polymers, and any combination thereof.

10. The consumer-disposable article according to claim 9, wherein the divalent or trivalent metal ion salt is selected from the group consisting of calcium chloride, calcium nitrate, magnesium chloride, magnesium nitrate, ferric chloride, ferrous chloride, zinc chloride, zinc nitrate, aluminum sulfate, ammonium zirconium carbonate, and any combination thereof.

11. The consumer-disposable article according to claim 6, wherein the composition further comprises an acid catalyst in the amount sufficient to provide a pH of the composition in the range from about 1.5 to about 5.0.

12. The consumer-disposable article according to claim 11, wherein the acid catalyst is selected from the group consisting of hydrochloric acid, sulfuric acid, phosphoric acid, citric acid, and any combination thereof.

13. The consumer-disposable article according to claim 6, wherein the modified starch has a weight average molecular weight greater than about 100,000 g/mol.

14. The consumer-disposable article according to claim 6, wherein the composition has an apparent extensional viscosity from about 150 Pascal·Seconds to about 13,000 Pascal·Seconds measured at the processing temperature and at an extension rate of about 90 $sec^{-1}$.

15. The consumer-disposable article according to claim 1, wherein the fiber has an average equivalent diameter of less than about 20 microns.

16. The consumer-disposable article according to claim 1, wherein the fiber has an average equivalent diameter of less than about 10 microns.

17. The consumer-disposable article according to claim 1, wherein the fiber has an average equivalent diameter of less than about 6 microns.

18. The consumer-disposable article according to claim 1 wherein the fiber is manufactured from a composition comprising from about 50% to about 99.5% by weight of modified starch.

19. The consumer-disposable article according to claim 18, wherein the modified starch comprises an oxidized starch.

20. The consumer-disposable article according to claim 1 wherein the consumer-disposable article is selected from the group consisting of: toilet paper, paper towels, napkins, facial tissue,diapers, feminine protection products, incontinence articles and mixtures thereof.

* * * * *

UNITED STATES PATENT AND TRADEMARK OFFICE

CERTIFICATE OF CORRECTION

PATENT NO. : 6,802,895 B2
DATED : October 12, 2004
INVENTOR(S) : Larry Neil Mackey et al.

It is certified that error appears in the above-identified patent and that said Letters Patent is hereby corrected as shown below:

Column 1,
Line 31, “theological” should read -- rheological --.

Column 8,
Line 59, “theological” should read -- rheological --

Column 9,
Line 1, “theological” should read -- rheological --.
Line 3, “unumodified” should read -- unmodified --.

Column 10,
Line 18, “theological” should read -- rheological --.

Column 11,
Line 32, “he fibers” should read -- the fibers --.

Column 17,
Line 30, “10%/o” should read -- 10% --.

Signed and Sealed this

First Day of February, 2005

JON W. DUDAS
*Director of the United States Patent and Trademark Office*